US011613952B2

(12) United States Patent
Doud et al.

(10) Patent No.: US 11,613,952 B2
(45) Date of Patent: Mar. 28, 2023

(54) FLUID ACTIVATED DISINTEGRATING METAL SYSTEM

(71) Applicant: Terves LLC, Euclid, OH (US)

(72) Inventors: Brian Doud, Euclid, OH (US); Andrew Sherman, Euclid, OH (US); Nicholas Farkas, Euclid, OH (US); Brian Werry, Euclid, OH (US)

(73) Assignee: TERVES, LLC, Euclid, OH (US)

( * ) Notice: Subject to any disclaimer, the term of this patent is extended or adjusted under 35 U.S.C. 154(b) by 70 days.

(21) Appl. No.: 17/124,723

(22) Filed: Dec. 17, 2020

(65) Prior Publication Data

US 2021/0101849 A1 Apr. 8, 2021

Related U.S. Application Data

(63) Continuation of application No. 16/110,550, filed on Aug. 23, 2018, now Pat. No. 11,365,164, which is a (Continued)

(51) Int. Cl.
*E21B 29/02* (2006.01)
*C06B 45/18* (2006.01)

(Continued)

(52) U.S. Cl.
CPC ..... *E21B 29/02* (2013.01); *C06B 45/18* (2013.01); *C06B 45/32* (2013.01); *E21B 31/002* (2013.01);

(Continued)

(58) Field of Classification Search
CPC ..... E21B 31/002; C06B 45/18; C06B 45/32
See application file for complete search history.

(56) References Cited

U.S. PATENT DOCUMENTS 1,468,905 A 7/1923 Herman
1,558,066 A 10/1925 Veazey et al.

(Continued)

FOREIGN PATENT DOCUMENTS

CA 2783241 6/2011
CA 2783346 6/2011

(Continued)

OTHER PUBLICATIONS

State Intellectual Property Office of People's Republic of China, First Office Action for corresponding China Patent Application No. 201580020103.7 (dated Aug. 11, 2017).

(Continued)

*Primary Examiner* — Kristyn A Hall
(74) *Attorney, Agent, or Firm* — Ulmer & Berne LLP; Brian E Turung

(57) ABSTRACT

An engineered composite system designed to be passive or inert under one set of conditions, but becomes active when exposed to a second set of conditions. This system can include a dissolving or disintegrating core, and a surface coating that has higher strength or which only dissolves under certain temperature and pH conditions, or in selected fluids. These reactive materials are useful for oil and gas completions and well stimulation processes, enhanced oil and gas recovery operations, as well as in defensive and mining applications requiring high energy density and good mechanical properties, but which can be stored and used for long periods of time without degradation.

27 Claims, 2 Drawing Sheets

Related U.S. Application Data continuation of application No. 14/627,189, filed on Feb. 20, 2015, now Pat. No. 10,150,713.

(60) Provisional application No. 61/942,870, filed on Feb. 21, 2014, provisional application No. 62/054,597, filed on Sep. 24, 2014.

(51) Int. Cl.
*E21B 31/00* (2006.01)
*C06B 45/32* (2006.01)
*E21B 33/12* (2006.01)

(52) U.S. Cl.
CPC ..... *E21B 33/12* (2013.01); *Y10T 428/12729* (2015.01); *Y10T 428/31605* (2015.04); *Y10T 428/31692* (2015.04)

(56) References Cited

U.S. PATENT DOCUMENTS 1,880,614 A 10/1932 Wetherill et al.
2,352,993 A 7/1933 Albertson
2,011,613 A 8/1935 Brown et al.
2,094,578 A 10/1937 Blumenthal et al.
2,189,697 A 2/1940 Baker
2,222,233 A 11/1940 Mize
2,225,143 A 12/1940 Baker et al.
2,238,895 A 4/1941 Gage
2,261,292 A 11/1941 Salnikov
2,294,648 A 9/1942 Ansel et al.
2,301,624 A 11/1942 Holt
2,394,843 A 2/1946 Cook et al.
2,672,199 A 3/1954 McKenna
2,753,941 A 7/1956 Hebard et al.
2,754,910 A 7/1956 Derrick et al.
2,933,136 A 4/1960 Ayers et al.
2,983,634 A 5/1961 Budininkas et al.
3,057,405 A 10/1962 Mallinger
3,066,391 A 12/1962 Vordahl et al.
3,106,959 A 10/1963 Huitt et al.
3,142,338 A 7/1964 Brown
3,152,009 A 10/1964 DeLong
3,180,728 A 4/1965 Pryor et al.
3,180,778 A 4/1965 Rinderspacher et al.
3,196,949 A 7/1965 Thomas
3,226,314 A 12/1965 Wellington et al.
3,242,988 A 3/1966 McGuire, Jr. et al.
3,295,935 A 1/1967 Pflumm et al.
3,298,440 A 1/1967 Current
3,316,748 A 5/1967 Lang et al.
3,326,291 A 6/1967 Zandemer
3,347,714 A 10/1967 Broverman et al.
3,385,696 A 5/1968 Hitchcock et al.
3,390,724 A 7/1968 Caldwell
3,395,758 A 8/1968 Kelly et al.
3,406,101 A 10/1968 Kilpatrick
3,416,918 A 12/1968 Roberts
3,434,539 A 3/1969 Merritt
3,445,148 A 5/1969 Harris et al.
3,445,731 A 5/1969 Saeki et al.
3,465,181 A 9/1969 Colby et al.
3,489,218 A 1/1970 Means
3,513,230 A 5/1970 Rhees et al.
3,600,163 A 8/1971 Badia et al.
3,602,305 A 8/1971 Kisling
3,637,446 A 1/1972 Elliott et al.
3,645,331 A 2/1972 Maurer et al.
3,660,049 A 5/1972 Benjamin
3,765,484 A 10/1973 Hamby, Jr. et al.
3,768,563 A 10/1973 Blount
3,775,823 A 12/1973 Adolph et al.
3,816,080 A 6/1974 Bomford et al.
3,823,045 A 7/1974 Hielema
3,878,889 A 4/1975 Seabourne
3,894,850 A 7/1975 Kovalchuk et al.
3,905,147 A 9/1975 Snipes et al.
3,924,677 A 12/1975 Prenner et al.
3,957,483 A 5/1976 Suzuki
4,010,583 A 3/1977 Highberg
4,039,717 A 8/1977 Titus
4,050,529 A 9/1977 Tagirov et al.
4,157,732 A 6/1979 Fonner
4,248,307 A 2/1981 Silberman et al.
4,264,362 A 4/1981 Sergev et al.
4,284,137 A 8/1981 Taylor
4,292,377 A 9/1981 Petersen et al.
4,368,788 A 1/1983 Drake
4,372,384 A 2/1983 Kinney
4,373,584 A 2/1983 Silberman et al.
4,373,952 A 2/1983 Parent
4,374,543 A 2/1983 Richardson
4,384,616 A 5/1983 Dellinger
4,395,440 A 7/1983 Abe et al.
4,399,871 A 8/1983 Adkins et al.
4,407,368 A 10/1983 Erbstoesser
4,422,508 A 12/1983 Rutledge, Jr. et al.
4,450,136 A 5/1984 Dudek et al.
4,452,311 A 6/1984 Speegle et al.
4,475,729 A 10/1984 Costigan
4,498,543 A 2/1985 Pye et al.
4,499,048 A 2/1985 Hanejko
4,499,049 A 2/1985 Hanejko
4,524,825 A 6/1985 Fore
4,526,840 A 7/1985 Jerabek
4,534,414 A 8/1985 Pringle
4,539,175 A 9/1985 Lichti et al.
4,554,986 A 11/1985 Jones
4,619,699 A 10/1986 Petkovic-Luton et al.
4,640,354 A 2/1987 Boisson
4,648,901 A 3/1987 Murray et al.
4,655,852 A 4/1987 Rallis
4,664,962 A 5/1987 DesMarais, Jr.
4,668,470 A 5/1987 Gilman et al.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,690,796 A 9/1987 Paliwal
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,716,964 A 1/1988 Erbstoesser et al.
4,719,971 A 1/1988 Owens
4,721,159 A 1/1988 Ohkochi et al.
4,738,599 A 4/1988 Shilling
4,741,973 A 5/1988 Condit et al.
4,768,588 A 9/1988 Kupsa
4,775,598 A 10/1988 Jaeckel
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,853,056 A 8/1989 Hoffman
4,869,324 A 9/1989 Holder
4,869,325 A 9/1989 Halbardier
4,875,948 A 10/1989 Vemnecker
4,880,059 A 11/1989 Brandell et al.
4,889,187 A 12/1989 Terrell et al.
4,890,675 A 1/1990 Dew
4,901,794 A 2/1990 Baugh et al.
4,909,320 A 3/1990 Hebert et al.
4,916,029 A 4/1990 Nagle et al.
4,917,966 A 4/1990 Wilde et al.
4,921,664 A 5/1990 Couper
4,929,415 A 5/1990 Okazaki
4,932,474 A 6/1990 Schroeder, Jr. et al.
4,934,459 A 6/1990 Baugh et al.

(56) References Cited

U.S. PATENT DOCUMENTS 4,938,309 A 7/1990 Emdy
4,938,809 A 7/1990 Das et al.
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Muuller et al.
4,997,622 A 3/1991 Regazzoni et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 DeLuccia
5,063,775 A 11/1991 Walker, Sr. et al.
5,073,207 A 12/1991 Faure et al.
5,074,361 A 12/1991 Brisco et al.
5,076,869 A 12/1991 Bourell et al.
5,084,088 A 1/1992 Okazaki
5,087,304 A 2/1992 Chang et al.
5,090,480 A 2/1992 Pittard et al.
5,095,988 A 3/1992 Bode
5,103,911 A 4/1992 Heijnen
5,106,702 A 4/1992 Walker et al.
5,117,915 A 6/1992 Mueller et al.
5,143,795 A 9/1992 Das et al.
5,161,614 A 11/1992 Wu et al.
5,171,734 A 12/1992 Sanjurjo et al.
5,178,216 A 1/1993 Giroux et al.
5,181,571 A 1/1993 Mueller et al.
5,183,631 A 2/1993 Kugimiya et al.
5,188,182 A 2/1993 Echols, III et al.
5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,238,646 A 8/1993 Tarcy et al.
5,240,742 A 8/1993 Johnson et al.
5,252,365 A 10/1993 White
5,253,714 A 10/1993 Davis et al.
5,271,468 A 12/1993 Streich et al.
5,273,569 A 12/1993 Gilman et al.
5,282,509 A 2/1994 Schurr, III
5,285,798 A 2/1994 Banerjee et al.
5,292,478 A 3/1994 Scorey
5,293,940 A 3/1994 Hromas et al.
5,304,260 A 4/1994 Aikawa et al.
5,304,588 A 4/1994 Boysen et al.
5,309,874 A 5/1994 Willermet et al.
5,310,000 A 5/1994 Arterbury et al.
5,316,598 A 5/1994 Chang et al.
5,318,746 A 6/1994 Lashmore et al.
5,336,466 A 8/1994 Iba
5,342,576 A 8/1994 Whitehead
5,352,522 A 10/1994 Kugimiya et al.
5,380,473 A 1/1995 Bogue et al.
5,387,380 A 2/1995 Cima et al.
5,392,860 A 2/1995 Ross
5,394,236 A 2/1995 Murnick
5,394,941 A 3/1995 Venditto et al.
5,398,754 A 3/1995 Dinhoble
5,407,011 A 4/1995 Layton
5,409,555 A 4/1995 Fujita et al.
5,411,082 A 5/1995 Kennedy
5,417,285 A 5/1995 Van Buskirk et al.
5,425,424 A 6/1995 Reinhardt et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,456,327 A 10/1995 Denton et al.
5,464,062 A 11/1995 Blizzard, Jr.
5,472,048 A 12/1995 Kennedy
5,474,131 A 12/1995 Jordan, Jr. et al.
5,476,632 A 12/1995 Shivanath et al.
5,477,923 A 12/1995 Jordan, Jr. et al.
5,479,986 A 1/1996 Gano et al.
5,494,538 A 2/1996 Kirillov et al.
5,506,055 A 4/1996 Dorfman et al.
5,507,439 A 4/1996 Story
5,511,620 A 4/1996 Baugh et al.
5,524,699 A 6/1996 Cook
5,526,880 A 6/1996 Jordan, Jr. et al.
5,526,881 A 6/1996 Martin et al.
5,529,746 A 6/1996 Knoss et al.
5,531,735 A 7/1996 Thompson
5,533,573 A 7/1996 Jordan, Jr. et al.
5,536,485 A 7/1996 Kume et al.
5,552,110 A 9/1996 Iba
5,558,153 A 9/1996 Holcombe et al.
5,601,924 A 2/1997 Beane et al.
5,607,017 A 3/1997 Owens et al.
5,623,993 A 4/1997 Van Buskirk et al.
5,623,994 A 4/1997 Robinson
5,641,023 A 6/1997 Ross et al.
5,636,691 A 7/1997 Hendrickson et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,722,033 A 2/1998 Carden
5,728,195 A 3/1998 Eastman et al.
5,765,639 A 6/1998 Muth
5,767,562 A 6/1998 Yamashita
5,772,735 A 6/1998 Sehgal et al.
5,782,305 A 7/1998 Hicks
5,797,454 A 8/1998 Hipp
5,820,608 A 10/1998 Luzio et al.
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,896,819 A 4/1999 Turila et al.
5,902,424 A 5/1999 Fujita et al.
5,934,372 A 8/1999 Muth
5,941,309 A 8/1999 Appleton
5,960,881 A 10/1999 Allamon et al.
5,964,965 A 10/1999 Schulz et al.
5,894,007 A 11/1999 Yuan et al.
5,980,602 A 11/1999 Carden
5,985,466 A 11/1999 Atarashi et al.
5,988,287 A 11/1999 Jordan, Jr. et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,030,637 A 2/2000 Whitehead
6,032,735 A 3/2000 Echols
6,033,622 A 3/2000 Maruyama
6,036,777 A 3/2000 Sachs
6,040,087 A 3/2000 Kawakami
6,047,773 A 4/2000 Zeltmann et al.
6,050,340 A 4/2000 Scott
6,069,313 A 5/2000 Kay
6,076,600 A 6/2000 Vick, Jr. et al.
6,079,496 A 6/2000 Hirth
6,085,837 A 7/2000 Massinon et al.
6,095,247 A 8/2000 Streich et al.
6,119,783 A 9/2000 Parker et al.
6,126,898 A 10/2000 Butler
6,142,237 A 11/2000 Christmas et al.
6,161,622 A 12/2000 Robb et al.

(56) References Cited

U.S. PATENT DOCUMENTS 6,167,970 B1 1/2001 Stout et al.
6,170,583 B1 1/2001 Boyce
6,171,359 B1 1/2001 Levinski et al.
6,173,779 B1 1/2001 Smith
6,176,323 B1 1/2001 Weirich et al.
6,189,616 B1 2/2001 Gano et al.
6,189,618 B1 2/2001 Beeman et al.
6,213,202 B1 4/2001 Read, Jr.
6,220,349 B1 4/2001 Vargus et al.
6,220,350 B1 4/2001 Brothers et al.
6,220,357 B1 4/2001 Carmichael et al.
6,228,904 B1 5/2001 Yadav et al.
6,230,799 B1 5/2001 Slaughter et al.
6,237,688 B1 5/2001 Burleson et al.
6,238,280 B1 5/2001 Ritt et al.
6,241,021 B1 6/2001 Bowling
6,248,399 B1 6/2001 Hehmann
6,250,392 B1 6/2001 Muth
6,261,432 B1 7/2001 Huber et al.
6,265,205 B1 7/2001 Hitchens et al.
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,287,332 B1 9/2001 Bolz et al.
6,287,445 B1 9/2001 Lashmore et al.
6,302,205 B1 10/2001 Ryll
6,315,041 B1 11/2001 Carlisle et al.
6,315,050 B2 11/2001 Vaylnshteyn et al.
6,325,148 B1 12/2001 Trahan et al.
6,328,110 B1 12/2001 Joubert
6,341,653 B1 1/2002 Fermaniuk et al.
6,341,747 B1 1/2002 Schmidt et al.
6,349,766 B1 2/2002 Bussear et al.
6,354,372 B1 3/2002 Carisell et al.
6,354,379 B2 3/2002 Miszewski et al.
6,371,206 B1 4/2002 Mills
6,372,346 B1 4/2002 Toth
6,382,244 B2 5/2002 Vann
6,390,195 B1 5/2002 Nguyen et al.
6,390,200 B1 5/2002 Allamon et al.
6,394,180 B1 5/2002 Berscheidt et al.
6,394,185 B1 5/2002 Constien
6,395,402 B1 5/2002 Lambert et al.
6,397,950 B1 6/2002 Streich et al.
6,401,547 B1 6/2002 Hatfield et al.
6,403,210 B1 6/2002 Stuivinga et al.
6,408,946 B1 6/2002 Marshall et al.
6,419,023 B1 7/2002 George et al.
6,422,314 B1 7/2002 Todd et al.
6,439,313 B1 8/2002 Thomeer et al.
6,444,316 B1 9/2002 Reddy et al.
6,446,717 B1 9/2002 White et al.
6,457,525 B1 10/2002 Scott
6,467,546 B2 10/2002 Allamon et al.
6,470,965 B1 10/2002 Winzer
6,491,097 B1 12/2002 Oneal et al.
6,491,116 B2 12/2002 Berscheidt et al.
6,513,598 B2 2/2003 Moore et al.
6,513,600 B2 2/2003 Ross
6,527,051 B1 3/2003 Reddy et al.
6,540,033 B1 4/2003 Sullivan et al.
6,543,543 B2 4/2003 Muth
6,554,071 B1 4/2003 Reddy et al.
6,561,275 B2 5/2003 Glass et al.
6,581,681 B1 6/2003 Zimmerman et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,609,569 B2 8/2003 Howlett et al.
6,612,826 B1 9/2003 Bauer et al.
6,613,383 B1 9/2003 George et al.
6,619,400 B2 9/2003 Brunet
6,630,008 B1 10/2003 Meeks, III et al.
6,634,428 B2 10/2003 Krauss et al.
6,662,886 B2 12/2003 Russell
6,675,889 B1 1/2004 Mullins et al.
6,699,305 B2 3/2004 Myrick
6,712,153 B2 3/2004 Turley et al.
6,712,797 B1 3/2004 Southern, Jr.
6,713,177 B2 3/2004 George et al.
6,715,541 B2 4/2004 Pedersen et al.
6,737,385 B2 5/2004 Todd et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,049 B2 5/2005 Moyes
6,896,061 B2 5/2005 Hriscu et al.
6,899,777 B2 5/2005 Vaidyanathan et al.
6,908,516 B2 6/2005 Hehmann et al.
6,913,827 B2 7/2005 George et al.
6,926,086 B2 8/2005 Patterson et al.
6,932,159 B2 8/2005 Hovem
6,939,388 B2 9/2005 Angeliu
6,945,331 B2 9/2005 Patel
6,951,331 B2 10/2005 Haughom et al.
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,013,998 B2 3/2006 Ray et al.
7,017,664 B2 3/2006 Walker et al.
7,017,677 B2 3/2006 Keshavan et al.
7,021,389 B2 4/2006 Bishop et al.
7,025,146 B2 4/2006 King et al.
7,028,778 B2 4/2006 Krywitsky
7,044,230 B2 5/2006 Starr et al.
7,048,812 B2 5/2006 Bettles et al.
7,049,272 B2 5/2006 Sinclair et al.
7,051,805 B2 5/2006 Doane et al.
7,059,410 B2 6/2006 Bousche et al.
7,063,748 B2 6/2006 Talton
7,090,027 B1 8/2006 Williams
7,093,664 B2 8/2006 Todd et al.
7,096,945 B2 8/2006 Richards et al.
7,096,946 B2 8/2006 Jasser et al.
7,097,807 B1 8/2006 Meeks, III et al.
7,097,906 B2 8/2006 Gardner
7,108,080 B2 9/2006 Tessari et al.
7,111,682 B2 9/2006 Blaisdell
7,128,145 B2 10/2006 Mickey
7,141,207 B2 11/2006 Jandeska, Jr. et al.
7,150,326 B2 12/2006 Bishop et al.
7,163,066 B2 1/2007 Lehr
7,165,622 B2 1/2007 Hirth et al.
7,168,494 B2 1/2007 Starr et al.
7,174,963 B2 2/2007 Bertelsen
7,182,135 B2 2/2007 Szarka
7,188,559 B1 3/2007 Vecchio
7,210,527 B2 5/2007 Walker et al.
7,210,533 B2 5/2007 Starr et al.
7,217,311 B2 5/2007 Hong et al.
7,234,530 B2 6/2007 Gass
7,250,188 B2 7/2007 Dodelet et al.
7,252,162 B2 8/2007 Akinlade et al.
7,255,172 B2 8/2007 Johnson
7,255,178 B2 8/2007 Slup et al.
7,264,060 B2 9/2007 Wills
7,267,172 B2 9/2007 Hofman
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,316,274 B2 1/2008 Xu et al.
7,320,365 B2 1/2008 Pia
7,322,412 B2 1/2008 Badalamenti et al.
7,322,417 B2 1/2008 Rytlewski et al.

(56) References Cited

U.S. PATENT DOCUMENTS

| | | | |
|---|---|---|---|
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |
| 7,346,456 | B2 | 3/2008 | Le Bemadjiel |
| 7,350,582 | B2 | 4/2008 | McKeachnie et al. |
| 7,353,867 | B2 | 4/2008 | Carter et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,373,978 | B2 | 5/2008 | Barry et al. |
| 7,380,600 | B2 | 6/2008 | Willberg et al. |
| 7,384,443 | B2 | 6/2008 | Mirchandani |
| 7,387,158 | B2 | 6/2008 | Murray et al. |
| 7,387,165 | B2 | 6/2008 | Lopez de Cardenas et al. |
| 7,392,841 | B2 | 7/2008 | Murray et al. |
| 7,401,648 | B2 | 7/2008 | Richard |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,752 | B2 | 12/2008 | Dale et al. |
| 7,464,764 | B2 | 12/2008 | Xu |
| 7,472,750 | B2 | 1/2009 | Walker et al. |
| 7,478,676 | B2 | 1/2009 | East, Jr. et al. |
| 7,491,444 | B2 | 2/2009 | Smith et al. |
| 7,503,390 | B2 | 3/2009 | Gomez |
| 7,503,392 | B2 | 3/2009 | King et al. |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,516,791 | B2 | 4/2009 | Bryant et al. |
| 7,520,944 | B2 | 4/2009 | Johnson |
| 7,527,103 | B2 | 5/2009 | Huang et al. |
| 7,531,020 | B2 | 5/2009 | Woodfield et al. |
| 7,531,021 | B2 | 5/2009 | Woodfield et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |
| 7,607,476 | B2 | 10/2009 | Tom et al. |
| 7,617,871 | B2 | 11/2009 | Surjaatmadja et al. |
| 7,635,023 | B2 | 12/2009 | Goldberg et al. |
| 7,640,988 | B2 | 1/2010 | Phi et al. |
| 7,647,964 | B2 | 1/2010 | Akbar et al. |
| 7,661,480 | B2 | 2/2010 | Al-Anazi |
| 7,661,481 | B2 | 2/2010 | Todd et al. |
| 7,665,537 | B2 | 2/2010 | Patel et al. |
| 7,686,082 | B2 | 3/2010 | Marsh |
| 7,690,436 | B2 | 4/2010 | Turley et al. |
| 7,699,101 | B2 | 4/2010 | Fripp et al. |
| 7,700,038 | B2 | 4/2010 | Soran et al. |
| 7,703,511 | B2 | 4/2010 | Buyers et al. |
| 7,708,078 | B2 | 5/2010 | Stoesz |
| 7,709,421 | B2 | 5/2010 | Jones et al. |
| 7,712,541 | B2 | 5/2010 | Loretz et al. |
| 7,723,272 | B2 | 5/2010 | Crews et al. |
| 7,726,406 | B2 | 6/2010 | Xu |
| 7,735,578 | B2 | 6/2010 | Loehr et al. |
| 7,743,836 | B2 | 6/2010 | Cook et al. |
| 7,752,971 | B2 | 7/2010 | Loehr |
| 7,757,773 | B2 | 7/2010 | Rytlewski |
| 7,762,342 | B2 | 7/2010 | Richard et al. |
| 7,770,652 | B2 | 8/2010 | Barnett |
| 7,771,289 | B2 | 8/2010 | Palumbo et al. |
| 7,775,284 | B2 | 8/2010 | Richard et al. |
| 7,775,285 | B2 | 8/2010 | Surjaatmadja et al. |
| 7,775,286 | B2 | 8/2010 | Duphorne |
| 7,784,543 | B2 | 8/2010 | Johnson |
| 7,793,714 | B2 | 9/2010 | Johnson |
| 7,793,820 | B2 | 9/2010 | Hirano et al. |
| 7,798,225 | B2 | 9/2010 | Giroux et al. |
| 7,798,226 | B2 | 9/2010 | Themig |
| 7,798,236 | B2 | 9/2010 | McKeachnie et al. |
| 7,806,189 | B2 | 10/2010 | Frazier |
| 7,806,192 | B2 | 10/2010 | Foster et al. |
| 7,810,553 | B2 | 10/2010 | Cruickshank et al. |
| 7,810,567 | B2 | 10/2010 | Daniels et al. |
| 7,819,198 | B2 | 10/2010 | Birckhead et al. |
| 7,828,055 | B2 | 11/2010 | Willauer et al. |
| 7,833,944 | B2 | 11/2010 | Munoz et al. |
| 7,849,927 | B2 | 12/2010 | Herrera |
| 7,851,016 | B2 | 12/2010 | Arbab et al. |
| 7,855,168 | B2 | 12/2010 | Fuller et al. |
| 7,861,779 | B2 | 1/2011 | Vestavik |
| 7,861,781 | B2 | 1/2011 | D'Arcy |
| 7,874,365 | B2 | 1/2011 | East, Jr. et al. |
| 7,878,253 | B2 | 2/2011 | Stowe et al. |
| 7,879,367 | B2 | 2/2011 | Heublein et al. |
| 7,896,091 | B2 | 3/2011 | Williamson et al. |
| 7,897,063 | B1 | 3/2011 | Perry et al. |
| 7,900,696 | B1 | 3/2011 | Nish et al. |
| 7,900,703 | B2 | 3/2011 | Clark et al. |
| 7,909,096 | B2 | 3/2011 | Clark et al. |
| 7,909,104 | B2 | 3/2011 | Bjorgum |
| 7,909,110 | B2 | 3/2011 | Sharma et al. |
| 7,909,115 | B2 | 3/2011 | Grove et al. |
| 7,913,765 | B2 | 3/2011 | Crow et al. |
| 7,918,275 | B2 | 4/2011 | Clem |
| 7,931,093 | B2 | 4/2011 | Foster et al. |
| 7,938,191 | B2 | 5/2011 | Vaidya |
| 7,946,335 | B2 | 5/2011 | Bewlay et al. |
| 7,946,340 | B2 | 5/2011 | Surjattmadja et al. |
| 7,958,940 | B2 | 6/2011 | Jameson |
| 7,963,331 | B2 | 6/2011 | Surjattmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 3,002,821 | A1 | 8/2011 | Stinson |
| 7,987,906 | B1 | 8/2011 | Troy |
| 7,992,763 | B2 | 8/2011 | Vecchio et al. |
| 7,999,987 | B2 | 8/2011 | Dellinger et al. |
| 3,020,619 | A1 | 9/2011 | Robertson et al. |
| 3,020,620 | A1 | 9/2011 | Daniels et al. |
| 3,025,104 | A1 | 9/2011 | Cooke, Jr. |
| 8,028,767 | B2 | 10/2011 | Radford et al. |
| 8,033,331 | B2 | 10/2011 | Themig |
| 8,039,422 | B1 | 10/2011 | Al-Zahrani |
| 8,056,628 | B2 | 11/2011 | Whitsitt et al. |
| 8,056,638 | B2 | 11/2011 | Clayton et al. |
| 8,109,340 | B2 | 2/2012 | Doane et al. |
| 8,114,148 | B2 | 2/2012 | Atanasoska et al. |
| 8,119,713 | B2 | 2/2012 | Dubois et al. |
| 8,127,856 | B1 | 3/2012 | Nish et al. |
| 8,153,052 | B2 | 4/2012 | Jackson et al. |
| 8,163,060 | B2 | 4/2012 | Imanishi et al. |
| 8,167,043 | B2 | 5/2012 | Willberg et al. |
| 8,211,247 | B2 | 7/2012 | Marya et al. |
| 8,211,248 | B2 | 7/2012 | Marya |
| 8,211,331 | B2 | 7/2012 | Jorgensen et al. |
| 8,220,554 | B2 | 7/2012 | Jordan et al. |
| 8,226,740 | B2 | 7/2012 | Chaumonnot et al. |
| 8,230,731 | B2 | 7/2012 | Dyer et al. |
| 8,231,947 | B2 | 7/2012 | Vaidya et al. |
| 8,263,178 | B2 | 9/2012 | Boulos et al. |
| 8,267,177 | B1 | 9/2012 | Vogel et al. |
| 8,276,670 | B2 | 10/2012 | Patel |
| 8,277,974 | B2 | 10/2012 | Kumar et al. |
| 8,297,364 | B2 | 10/2012 | Agrawal et al. |
| 8,327,931 | B2 | 12/2012 | Agrawal et al. |
| 8,403,037 | B2 | 3/2013 | Agrawal et al. |
| 8,413,727 | B2 | 4/2013 | Holmes |

(56) References Cited

U.S. PATENT DOCUMENTS

| | | | |
|---|---|---|---|
| 8,425,651 | B2 | 4/2013 | Xu et al. |
| 8,459,347 | B2 | 6/2013 | Stout |
| 8,485,265 | B2 | 7/2013 | Marya et al. |
| 8,490,674 | B2 | 7/2013 | Stevens et al. |
| 8,490,689 | B1 | 7/2013 | McClinton et al. |
| 8,528,633 | B2 | 9/2013 | Agrawal et al. |
| 8,535,604 | B1 | 9/2013 | Baker et al. |
| 8,573,295 | B2 | 11/2013 | Johnson et al. |
| 8,579,023 | B1 | 11/2013 | Nish et al. |
| 8,613,789 | B2 | 12/2013 | Han et al. |
| 8,631,876 | B2 | 1/2014 | Xu et al. |
| 8,663,401 | B2 | 3/2014 | Marya et al. |
| 8,695,684 | B2 | 4/2014 | Chen et al. |
| 8,695,714 | B2 | 4/2014 | Xu |
| 8,714,268 | B2 | 5/2014 | Agrawal et al. |
| 8,715,339 | B2 | 5/2014 | Atanasoska et al. |
| 8,723,564 | B2 | 5/2014 | Kim et al. |
| 8,734,564 | B2 | 5/2014 | Kim et al. |
| 8,734,602 | B2 | 5/2014 | Li et al. |
| 8,746,342 | B1 | 6/2014 | Nish et al. |
| 8,770,261 | B2 | 7/2014 | Marya |
| 8,776,884 | B2 | 7/2014 | Xu |
| 8,789,610 | B2 | 7/2014 | Oxford |
| 8,808,423 | B2 | 8/2014 | Kim et al. |
| 8,950,504 | B2 | 2/2015 | Xu et al. |
| 8,956,660 | B2 | 2/2015 | Launag et al. |
| 8,978,734 | B2 | 3/2015 | Stevens |
| 8,991,485 | B2 | 3/2015 | Chenault et al. |
| 8,998,978 | B2 | 4/2015 | Wang |
| 9,010,416 | B2 | 4/2015 | Xu et al. |
| 9,016,363 | B2 | 4/2015 | Xu et al. |
| 9,016,384 | B2 | 4/2015 | Xu |
| 9,022,107 | B2 | 5/2015 | Agrawal et al. |
| 9,027,655 | B2 | 5/2015 | Xu |
| 9,033,041 | B2 | 5/2015 | Baihly et al. |
| 9,033,060 | B2 | 5/2015 | Xu et al. |
| 9,044,397 | B2 | 6/2015 | Choi et al. |
| 9,057,117 | B2 | 6/2015 | Harrison et al. |
| 9,057,242 | B2 | 6/2015 | Mazyar et al. |
| 9,068,428 | B2 | 6/2015 | Mazyar et al. |
| 9,010,424 | B2 | 7/2015 | Xu |
| 9,079,246 | B2 | 7/2015 | Xu et al. |
| 9,080,098 | B2 | 7/2015 | Xu et al. |
| 9,080,403 | B2 | 7/2015 | Xu et al. |
| 9,080,439 | B2 | 7/2015 | O'Malley |
| 9,089,408 | B2 | 7/2015 | Xu |
| 9,090,955 | B2 | 7/2015 | Xu et al. |
| 9,090,956 | B2 | 7/2015 | Xu |
| 9,109,429 | B2 | 8/2015 | Xu et al. |
| 9,119,906 | B2 | 9/2015 | Fomantschager et al. |
| 9,127,515 | B2 | 9/2015 | Xu et al. |
| 9,163,467 | B2 | 10/2015 | Gaudette et al. |
| 9,187,686 | B2 | 11/2015 | Crews |
| 9,211,586 | B1 | 12/2015 | Lavernia et al. |
| 9,217,319 | B2 | 12/2015 | Frazier et al. |
| 9,227,243 | B2 | 1/2016 | Xu |
| 9,243,475 | B2 | 1/2016 | Xu |
| 9,260,935 | B2 | 2/2016 | Murphree et al. |
| 9,284,803 | B2 | 3/2016 | Stone et al. |
| 9,309,733 | B2 | 4/2016 | Xu et al. |
| 9,309,744 | B2 | 4/2016 | Frazier |
| 9,366,106 | B2 | 6/2016 | Xu et al. |
| 9,447,482 | B2 | 9/2016 | Kim et al. |
| 9,458,692 | B2 | 10/2016 | Fripp et al. |
| 9,500,061 | B2 | 11/2016 | Frazier et al. |
| 9,528,343 | B2 | 12/2016 | Jordan et al. |
| 9,587,156 | B2 | 3/2017 | Crews |
| 9,643,250 | B2 | 5/2017 | Mazyar et al. |
| 9,682,425 | B2 | 6/2017 | Xu et al. |
| 9,689,227 | B2 | 6/2017 | Fripp et al. |
| 9,689,231 | B2 | 6/2017 | Fripp et al. |
| 9,789,663 | B2 | 10/2017 | Zhang et al. |
| 9,790,763 | B2 | 10/2017 | Fripp et al. |
| 9,802,250 | B2 | 10/2017 | Xu |
| 9,803,439 | B2 | 10/2017 | Xu et al. |
| 9,833,838 | B2 | 12/2017 | Mazyar et al. |
| 9,835,016 | B2 | 12/2017 | Zhang et al. |
| 9,863,201 | B2 | 1/2018 | Fripp et al. |
| 9,925,589 | B2 | 3/2018 | Xu |
| 9,926,763 | B2 | 3/2018 | Mazyar et al. |
| 9,938,451 | B2 | 4/2018 | Crews |
| 9,970,249 | B2 | 5/2018 | Zhang et al. |
| 10,016,810 | B2 | 7/2018 | Salinas et al. |
| 10,059,092 | B2 | 8/2018 | Welch et al. |
| 10,059,867 | B2 | 8/2018 | Crews |
| 10,081,853 | B2 | 9/2018 | Wilks et al. |
| 10,082,008 | B2 | 9/2018 | Robey et al. |
| 10,092,953 | B2 | 10/2018 | Mazyar et al. |
| 10,119,358 | B2 | 11/2018 | Walton et al. |
| 10,119,359 | B2 | 11/2018 | Frazier |
| 10,125,565 | B2 | 11/2018 | Fripp et al. |
| 10,167,691 | B2 | 1/2019 | Zhang et al. |
| 10,202,820 | B2 | 2/2019 | Xu et al. |
| 10,221,637 | B2 | 3/2019 | Xu et al. |
| 10,221,641 | B2 | 3/2019 | Zhang et al. |
| 10,221,642 | B2 | 3/2019 | Zhang et al. |
| 10,221,643 | B2 | 3/2019 | Zhang et al. |
| 10,227,841 | B2 | 3/2019 | Fripp et al. |
| 10,253,590 | B2 | 4/2019 | Xu et al. |
| 10,266,923 | B2 | 4/2019 | Wilks et al. |
| 10,316,601 | B2 | 6/2019 | Walton et al. |
| 10,329,643 | B2 | 6/2019 | Wilks et al. |
| 10,335,855 | B2 | 7/2019 | Welch et al. |
| 10,337,086 | B2 | 7/2019 | Wilks et al. |
| 10,344,568 | B2 | 7/2019 | Murphree et al. |
| 10,364,630 | B2 | 7/2019 | Xu et al. |
| 10,364,631 | B2 | 7/2019 | Xu et al. |
| 10,364,632 | B2 | 7/2019 | Xu et al. |
| 10,450,840 | B2 | 10/2019 | Xu |
| 10,472,909 | B2 | 11/2019 | Xu et al. |
| 10,533,392 | B2 | 1/2020 | Walton et al. |
| 10,544,652 | B2 | 1/2020 | Fripp et al. |
| 10,597,965 | B2 | 3/2020 | Allen |
| 10,612,659 | B2 | 4/2020 | Xu et al. |
| 10,619,438 | B2 | 4/2020 | Fripp et al. |
| 10,619,445 | B2 | 4/2020 | Murphree et al. |
| 10,626,695 | B2 | 4/2020 | Fripp et al. |
| 10,633,947 | B2 | 4/2020 | Fripp et al. |
| 10,655,411 | B2 | 5/2020 | Fripp et al. |
| 10,669,797 | B2 | 6/2020 | Johnson et al. |
| 10,724,321 | B2 | 7/2020 | Leonard et al. |
| 10,737,321 | B2 | 8/2020 | Xu |
| 10,781,658 | B1 | 9/2020 | Kumar et al. |
| 10,807,355 | B2 | 10/2020 | Welch et al. |
| 2002/0020527 | A1 | 2/2002 | Kilaas et al. |
| 2002/0047058 | A1 | 4/2002 | Verhoff et al. |
| 2002/0092654 | A1 | 7/2002 | Coronado et al. |
| 2002/0104616 | A1 | 8/2002 | De et al. |
| 2002/0108756 | A1 | 8/2002 | Harrall et al. |
| 2002/0121081 | A1 | 9/2002 | Cesaroni et al. |
| 2002/0139541 | A1 | 10/2002 | Sheffield et al. |
| 2002/0197181 | A1 | 12/2002 | Osawa et al. |
| 2003/0019639 | A1 | 1/2003 | Mackay |
| 2003/0060374 | A1 | 3/2003 | Cooke, Jr. |
| 2003/0104147 | A1 | 6/2003 | Bretschneider et al. |
| 2003/0111728 | A1 | 6/2003 | Thai et al. |
| 2003/0127013 | A1 | 7/2003 | Zavitsanos et al. |
| 2003/0141060 | A1 | 7/2003 | Hailey, Jr. et al. |
| 2003/0150614 | A1 | 8/2003 | Brown et al. |
| 2003/0155114 | A1 | 8/2003 | Pedersen et al. |
| 2003/0173005 | A1 | 9/2003 | Higashi |
| 2004/0005483 | A1 | 1/2004 | Lin |
| 2004/0055758 | A1 | 3/2004 | Brezinski et al. |
| 2004/0069502 | A1 | 4/2004 | Luke |
| 2004/0089449 | A1 | 5/2004 | Walton et al. |
| 2004/0094297 | A1 | 5/2004 | Malone et al. |
| 2004/0154806 | A1 | 8/2004 | Bode et al. |
| 2004/0159446 | A1 | 8/2004 | Haugen et al. |
| 2004/0216868 | A1 | 11/2004 | Owens, Sr. |
| 2004/0231845 | A1 | 11/2004 | Cooke, Jr. |
| 2004/0244968 | A1 | 12/2004 | Cook et al. |
| 2004/0256109 | A1 | 12/2004 | Johnson |
| 2004/0261993 | A1 | 12/2004 | Nguyen |
| 2004/0261994 | A1 | 12/2004 | Nguyen et al. |

(56) References Cited

U.S. PATENT DOCUMENTS

2005/0064247 A1 3/2005 Sane et al.
2005/0074612 A1 4/2005 Eklund et al.
2005/0098313 A1 5/2005 Atkins et al.
2005/0102255 A1 5/2005 Bultman
2005/0106316 A1 5/2005 Rigney et al.
2005/0161212 A1 7/2005 Leismer et al.
2005/0165149 A1 7/2005 Chanak et al.
2005/0194141 A1 9/2005 Sinclair et al.
2005/0235757 A1 10/2005 De Jonge et al.
2005/0241824 A1 11/2005 Burris, II et al.
2005/0241825 A1 11/2005 Burris, II et al.
2005/0268746 A1 12/2005 Abkowitz et al.
2005/0269097 A1 12/2005 Towler
2005/0275143 A1 12/2005 Toth
2005/0279427 A1 12/2005 Park et al.
2005/0279501 A1 12/2005 Surjaatmadja et al.
2006/0012087 A1 1/2006 Matsuda et al.
2006/0013350 A1 1/2006 Akers
2006/0057479 A1 3/2006 Niimi et al.
2006/0102871 A1 5/2006 Wang et al.
2006/0108114 A1 5/2006 Johnson
2006/0110615 A1 5/2006 Karim et al.
2006/0113077 A1 6/2006 Willberg et al.
2006/0116696 A1 6/2006 Odermatt et al.
2006/0131031 A1 6/2006 McKeachnie
2006/0131081 A1 6/2006 Mirchandani et al.
2006/0144515 A1 7/2006 Tada et al.
2006/0150770 A1 7/2006 Freim, III et al.
2006/0153728 A1 7/2006 Schoenung et al.
2006/0169453 A1 8/2006 Savery et al.
2006/0175059 A1 8/2006 Sinclair et al.
2006/0186602 A1 8/2006 Martin et al.
2006/0207387 A1 9/2006 Soran et al.
2006/0269437 A1 11/2006 Pandey
2006/0278405 A1 12/2006 Turley
2006/0283592 A1 12/2006 Sierra et al.
2007/0017675 A1 1/2007 Hammami et al.
2007/0134496 A1 1/2007 Katagiri et al.
2007/0039161 A1 2/2007 Garcia
2007/0044958 A1 3/2007 Rytlewski et al.
2007/0044966 A1 3/2007 Davies et al.
2007/0051521 A1 3/2007 Fike et al.
2007/0053785 A1 3/2007 Hetz et al.
2007/0054101 A1 3/2007 Sigalas et al.
2007/0057415 A1 3/2007 Katagiri et al.
2007/0062644 A1 3/2007 Nakamura et al.
2007/0102199 A1 5/2007 Smith et al.
2007/0107899 A1 5/2007 Werner et al.
2007/0108060 A1 5/2007 Park
2007/0131912 A1 6/2007 Simone et al.
2007/0151009 A1 7/2007 Conrad, III et al.
2007/0151769 A1 7/2007 Slutz et al.
2007/0181224 A1 8/2007 Marya et al.
2007/0187095 A1 8/2007 Walker et al.
2007/0207182 A1 9/2007 Weber et al.
2007/0221373 A1 9/2007 Murray
2007/0227745 A1 10/2007 Roberts et al.
2007/0259994 A1 11/2007 Tour et al.
2007/0270942 A1 11/2007 Thomas
2007/0284112 A1 12/2007 Magne et al.
2007/0299510 A1 12/2007 Venkatraman et al.
2008/0011473 A1 1/2008 Wood et al.
2008/0020923 A1 1/2008 Debe et al.
2008/0041500 A1 2/2008 Bronfin
2008/0047707 A1 2/2008 Boney et al.
2008/0060810 A9 3/2008 Nguyen et al.
2008/0081866 A1 4/2008 Gong et al.
2008/0093073 A1 4/2008 Bustos et al.
2008/0105438 A1* 5/2008 Jordan ..... E21B 7/061
166/117.6
2008/0121436 A1 5/2008 Slay et al.
2008/0127475 A1 6/2008 Griffo
2008/0149325 A1 6/2008 Crawford
2008/0149345 A1 6/2008 Marya et al.
2008/0149351 A1 6/2008 Marya et al.
2008/0169130 A1 7/2008 Norman et al.
2008/0175744 A1 7/2008 Motegi
2008/0179104 A1 7/2008 Zhang et al.
2008/0196801 A1 8/2008 Zhao et al.
2008/0202764 A1 8/2008 Clayton et al.
2008/0202814 A1 8/2008 Lyons et al.
2008/0210473 A1 9/2008 Zhang et al.
2008/0216383 A1 9/2008 Pierick et al.
2008/0220991 A1 9/2008 Slay et al.
2008/0223587 A1 9/2008 Cherewyk
2008/0236829 A1 10/2008 Lynde
2008/0236842 A1 10/2008 Bhavsar et al.
2008/0248205 A1 10/2008 Blanchet et al.
2008/0248413 A1 10/2008 Ishii et al.
2008/0264205 A1 10/2008 Zeng et al.
2008/0264594 A1 10/2008 Lohmueller et al.
2008/0277980 A1 11/2008 Koda et al.
2008/0282924 A1 11/2008 Saenger et al.
2008/0296024 A1 12/2008 Huang et al.
2008/0302538 A1 12/2008 Hofman
2008/0314581 A1 12/2008 Brown
2008/0314588 A1 12/2008 Langlais et al.
2009/0038858 A1 2/2009 Griffo et al.
2009/0044946 A1 2/2009 Shasteen et al.
2009/0044955 A1 2/2009 King et al.
2009/0050334 A1 2/2009 Marya et al.
2009/0056934 A1 3/2009 Xu
2009/0065216 A1 3/2009 Frazier
2009/0068051 A1 3/2009 Gross
2009/0074603 A1 3/2009 Chan et al.
2009/0084600 A1 4/2009 Severance
2009/0090440 A1 4/2009 Kellett
2009/0107684 A1 4/2009 Cooke, Jr.
2009/0114381 A1 5/2009 Stroobants
2009/0116992 A1 5/2009 Lee
2009/0126436 A1 5/2009 Fly et al.
2009/0151949 A1 6/2009 Marya et al.
2009/0152009 A1 6/2009 Slay et al.
2009/0155616 A1 6/2009 Thamida
2009/0159289 A1 6/2009 Avant et al.
2009/0194745 A1 8/2009 Tanaka
2009/0205841 A1 8/2009 Kluge et al.
2009/0211770 A1 8/2009 Nutley et al.
2009/0226340 A1 9/2009 Marya
2009/0226704 A1 9/2009 Kauppinen et al.
2009/0242202 A1 10/2009 Rispler et al.
2009/0242208 A1 10/2009 Bolding
2009/0255667 A1 10/2009 Clem et al.
2009/0255684 A1 10/2009 Bolding
2009/0255686 A1 10/2009 Richard et al.
2009/0260817 A1 10/2009 Gambier et al.
2009/0266548 A1 10/2009 Olsen et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0308588 A1 12/2009 Howell et al.
2009/0317556 A1 12/2009 Macary
2009/0317622 A1 12/2009 Huang et al.
2010/0003536 A1 1/2010 Smith et al.
2010/0012385 A1 1/2010 Drivdahl et al.
2010/0015002 A1 1/2010 Barrera et al.
2010/0015469 A1 1/2010 Romanowski
2010/0025255 A1 2/2010 Su et al.
2010/0038076 A1 2/2010 Spray et al.
2010/0038595 A1 2/2010 Imholt et al.
2010/0040180 A1 2/2010 Kim et al.
2010/0044041 A1 2/2010 Smith et al.
2010/0051278 A1 3/2010 Mytopher et al.
2010/0055492 A1 3/2010 Baroum et al.
2010/0089583 A1 4/2010 Xu et al.
2010/0116495 A1 5/2010 Spray
2010/0119405 A1 5/2010 Okamoto et al.
2010/0139930 A1 6/2010 Patel et al.
2010/0161031 A1 6/2010 Papirov et al.
2010/0200230 A1 8/2010 East, Jr. et al.
2010/0236793 A1 9/2010 Bjorgum
2010/0236794 A1 9/2010 Duan et al.
2010/0243254 A1 9/2010 Murphy et al.

(56) References Cited

U.S. PATENT DOCUMENTS

2010/0252273 A1 10/2010 Duphorne
2010/0252280 A1 10/2010 Swor et al.
2010/0270031 A1 10/2010 Patel
2010/0276136 A1 11/2010 Evans et al.
2010/0276159 A1 11/2010 Mailand et al.
2010/0282338 A1 11/2010 Gerrard et al.
2010/0282469 A1 11/2010 Richard et al.
2010/0297432 A1 11/2010 Sherman et al.
2010/0304178 A1 12/2010 Dirscherl
2010/0304182 A1 12/2010 Facchini et al.
2010/0314105 A1 12/2010 Rose
2010/0314127 A1 12/2010 Swor et al.
2010/0319427 A1 12/2010 Lohbeck et al.
2010/0326650 A1 12/2010 Tran et al.
2011/0005773 A1 1/2011 Dusterhoft et al.
2011/0036592 A1 2/2011 Fay
2011/0048743 A1 3/2011 Stafford et al.
2011/0052805 A1 3/2011 Bordere et al.
2011/0067872 A1 3/2011 Agrawal
2011/0067889 A1 3/2011 Marya et al.
2011/0091660 A1 4/2011 Dirscherl
2011/0094406 A1 4/2011 Marya et al.
2011/0094737 A1* 4/2011 Chen ..... C09K 8/52 166/305.1
2011/0135530 A1 6/2011 Xu et al.
2011/0135805 A1 6/2011 Doucet et al.
2011/0139465 A1 6/2011 Tibbles et al.
2011/0147014 A1 6/2011 Chen et al.
2011/0186306 A1 8/2011 Marya et al.
2011/0192613 A1 8/2011 Garcia et al.
2011/0214881 A1 9/2011 Newton et al.
2011/0221137 A1 9/2011 Obi et al.
2011/0236249 A1 9/2011 Kim et al.
2011/0247833 A1 10/2011 Todd et al.
2011/0253387 A1 10/2011 Ervin
2011/0259610 A1 10/2011 Shkurti et al.
2011/0277987 A1 11/2011 Frazier
2011/0277989 A1 11/2011 Frazier
2011/0277996 A1 11/2011 Cullick et al.
2011/0284232 A1 11/2011 Huang
2011/0284240 A1 11/2011 Chen et al.
2011/0284243 A1 11/2011 Frazier
2011/0300403 A1 12/2011 Vecchio et al.
2011/0314881 A1 12/2011 Hatcher et al.
2012/0046732 A1 2/2012 Sillekens et al.
2012/0067426 A1 3/2012 Soni et al.
2012/0080189 A1 4/2012 Marya et al.
2012/0090839 A1 4/2012 Rudic
2012/0097384 A1 4/2012 Valencia et al.
2012/0103135 A1 5/2012 Xu et al.
2012/0125642 A1 5/2012 Chenault
2012/0130470 A1 5/2012 Agnew et al.
2012/0145378 A1 6/2012 Frazier
2012/0145389 A1 6/2012 Fitzpatrick, Jr.
2012/0156087 A1 6/2012 Kawabata
2012/0168152 A1 7/2012 Casciaro
2012/0177905 A1 7/2012 Seals et al.
2012/0190593 A1 7/2012 Soane et al.
2012/0205120 A1 8/2012 Howell
2012/0205872 A1 8/2012 Reinhardt et al.
2012/0211239 A1 8/2012 Kritzler et al.
2012/0234546 A1 9/2012 Xu
2012/0234547 A1 9/2012 O'Malley et al.
2012/0247765 A1 10/2012 Agrawal et al.
2012/0267101 A1 10/2012 Cooke, Jr.
2012/0269673 A1 10/2012 Koo et al.
2012/0273229 A1* 11/2012 Xu ..... B22F 7/02 427/596
2012/0318513 A1 12/2012 Mazyar et al.
2013/0000985 A1 1/2013 Agrawal et al.
2013/0008671 A1 1/2013 Booth
2013/0017610 A1 1/2013 Roberts et al.
2013/0022816 A1 1/2013 Smith et al.
2013/0029886 A1 1/2013 Mazyar et al.
2013/0032357 A1 2/2013 Mazyar et al.
2013/0043041 A1 2/2013 McCoy et al.
2013/0047785 A1 2/2013 Xu
2013/0052472 A1 2/2013 Xu
2013/0056215 A1 3/2013 Crews
2013/0062049 A1* 3/2013 Ren ..... B29C 44/5636 264/45.3
2013/0068411 A1 3/2013 Forde et al.
2013/0068461 A1 3/2013 Maerz et al.
2013/0084643 A1 4/2013 Commarieu et al.
2013/0105159 A1 5/2013 Alvarez et al.
2013/0112429 A1 5/2013 Crews
2013/0126190 A1 5/2013 Mazyar et al.
2013/0133897 A1 5/2013 Bailhly et al.
2013/0144290 A1 6/2013 Schiffl et al.
2013/0146144 A1 6/2013 Joseph et al.
2013/0160992 A1 6/2013 Agrawal et al.
2013/0167502 A1 7/2013 Wilson et al.
2013/0168257 A1 7/2013 Mazyar et al.
2013/0186626 A1 7/2013 Aitken et al.
2013/0199800 A1 8/2013 Kellner et al.
2013/0209308 A1 8/2013 Mazyar et al.
2013/0220496 A1 8/2013 Inoue et al.
2013/0240200 A1 9/2013 Frazier
2013/0240203 A1 9/2013 Frazier
2013/0261735 A1 10/2013 Pacetti et al.
2013/0277044 A1 10/2013 King et al.
2013/0310961 A1 11/2013 Velez
2013/0048289 A1 12/2013 Mazyar
2013/0319668 A1 12/2013 Tschetter et al.
2013/0327540 A1 12/2013 Hamid et al.
2013/0333899 A1* 12/2013 Xu ..... E21B 17/1007 166/241.1
2014/0018489 A1 1/2014 Johnson
2014/0020712 A1 1/2014 Benson
2014/0027128 A1 1/2014 Johnson
2014/0060834 A1 3/2014 Quintero
2014/0093417 A1 4/2014 Liu
2014/0110112 A1 4/2014 Jordan, Jr.
2014/0116711 A1 5/2014 Tang
2014/0124216 A1 5/2014 Fripp et al.
2014/0154341 A1 6/2014 Manuel et al.
2014/0186207 A1 7/2014 Bae et al.
2014/0190705 A1 7/2014 Fripp
2014/0196889 A1 7/2014 Jordan et al.
2014/0202284 A1 7/2014 Kim et al.
2014/0202708 A1 7/2014 Jacob et al.
2014/0219861 A1 8/2014 Han
2014/0224477 A1 8/2014 Wiese et al.
2014/0236284 A1 8/2014 Stinson
2014/0271333 A1 9/2014 Kim et al.
2014/0286810 A1 9/2014 Marya
2014/0305627 A1 10/2014 Manke
2014/0311731 A1 10/2014 Smith
2014/0311752 A1 10/2014 Streich et al.
2014/0360728 A1 12/2014 Tashiro et al.
2014/0374086 A1 12/2014 Agrawal et al.
2015/0060085 A1 3/2015 Xu
2015/0065401 A1 3/2015 Xu et al.
2015/0102179 A1 4/2015 McHenry et al.
2015/0184485 A1 7/2015 Xu et al.
2015/0240337 A1 8/2015 Sherman et al.
2015/0247376 A1 9/2015 Tolman
2015/0299838 A1 10/2015 Doud
2015/0354311 A1 12/2015 Okura et al.
2016/0024619 A1 1/2016 Wilkes et al.
2016/0128849 A1 5/2016 Yan et al.
2016/0201425 A1 7/2016 Walton
2016/0201427 A1 7/2016 Fripp
2016/0201435 A1 7/2016 Fripp et al.
2016/0209391 A1 7/2016 Zhang et al.
2016/0230494 A1 8/2016 Fripp et al.
2016/0251934 A1 9/2016 Walton et al.
2016/0258242 A1 9/2016 Hayter et al.
2016/0265091 A1 9/2016 Walton et al.
2016/0272882 A1 9/2016 Stray et al.
2016/0279709 A1 9/2016 Xu et al.
2017/0050159 A1 2/2017 Xu et al.
2017/0266923 A1 9/2017 Guest et al.
2017/0356266 A1 12/2017 Arackakudiyil et al.

(56) References Cited

U.S. PATENT DOCUMENTS

| | | | |
|---|---|---|---|
| 2018/0010217 | A1 | 1/2018 | Wilks et al. |
| 2018/0023359 | A1 | 1/2018 | Xu |
| 2018/0178289 | A1 | 6/2018 | Xu et al. |
| 2018/0187510 | A1 | 7/2018 | Xu et al. |
| 2018/0216431 | A1 | 8/2018 | Walton et al. |
| 2018/0274317 | A1 | 9/2018 | Hall |
| 2019/0054523 | A1 | 2/2019 | Wolf et al. |
| 2019/0093450 | A1 | 3/2019 | Walton et al. |
| 2019/0203563 | A1 | 7/2019 | Gano et al. |
| 2019/0249510 | A1 | 8/2019 | Deng et al. |

FOREIGN PATENT DOCUMENTS

| | | |
|---|---|---|
| CA | 2886988 | 10/2015 |
| CN | 1076968 | 10/1993 |
| CN | 1079234 | 12/1993 |
| CN | 1255879 | 6/2000 |
| CN | 1668545 | 9/2005 |
| CN | 1882759 | 12/2006 |
| CN | 101050417 | 10/2007 |
| CN | 101351523 | 1/2009 |
| CN | 101381829 | 3/2009 |
| CN | 101392345 | 3/2009 |
| CN | 101454074 | 6/2009 |
| CN | 101457321 | 6/2009 |
| CN | 101605963 | 12/2009 |
| CN | 101720378 | 6/2010 |
| CN | 102517489 | 6/2012 |
| CN | 102796928 | 11/2012 |
| CN | 103343271 | 10/2013 |
| CN | 103602865 | 2/2014 |
| CN | 103898384 | 7/2014 |
| CN | 104152775 | 11/2014 |
| CN | 104480354 | 4/2015 |
| CN | 201532089 | 4/2015 |
| CN | 10577976 | 7/2016 |
| CN | 106086559 | 11/2016 |
| EA | 200600343 | 6/2006 |
| EA | 200870227 | 2/2009 |
| EP | 0033625 | 8/1981 |
| EP | 0400574 | 5/1990 |
| EP | 0470599 | 2/1998 |
| EP | 1006258 | 1/2000 |
| EP | 1174385 | 1/2002 |
| EP | 1412175 | 4/2004 |
| EP | 1493517 | 1/2005 |
| EP | 1798301 | 6/2007 |
| EP | 1857570 | 11/2007 |
| EP | 2088217 | 8/2009 |
| GB | 912956 | 12/1962 |
| GB | 1046330 | 10/1966 |
| GB | 1280833 | 7/1972 |
| GB | 1357065 | 6/1974 |
| GB | 2095288 | 9/1982 |
| GB | 2529062 | 2/2016 |
| JP | H10147830 | 6/1998 |
| JP | 2000073152 | 3/2000 |
| JP | 2000185725 | 7/2000 |
| JP | 2002053902 | 2/2002 |
| JP | 2004154837 | 6/2004 |
| JP | 2004225084 | 8/2004 |
| JP | 2004225765 | 8/2004 |
| JP | 2005076052 | 3/2005 |
| JP | 2008266734 | 11/2008 |
| JP | 2008280565 | 11/2008 |
| JP | 2009144207 | 7/2009 |
| JP | 2010502840 | 1/2010 |
| JP | 2012197491 | 10/2012 |
| JP | 2013019030 | 1/2013 |
| JP | 2014043601 | 3/2014 |
| JP | 2014174013 | 9/2014 |
| KR | 20130023707 | 3/2013 |
| RU | 2373375 | 7/2006 |
| WO | 9111587 | 8/1881 |
| WO | 1990002655 | 3/1990 |
| WO | 9200961 | 1/1992 |
| WO | 1992013978 | 8/1992 |
| WO | 9857347 | 12/1998 |
| WO | 9909227 | 2/1999 |
| WO | 9947726 | 9/1999 |
| WO | 2001001087 | 1/2001 |
| WO | 2004001087 | 12/2003 |
| WO | 2004073889 | 9/2004 |
| WO | 2005065281 | 7/2005 |
| WO | 2007044635 | 4/2007 |
| WO | 2007095376 | 8/2007 |
| WO | 2008017156 | 2/2008 |
| WO | 2008034042 | 3/2008 |
| WO | 2008057045 | 5/2008 |
| WO | 2008079485 | 7/2008 |
| WO | 2008079777 | 7/2008 |
| WO | 2008142129 | 11/2008 |
| WO | 2009055354 | 4/2009 |
| WO | 2009079745 | 7/2009 |
| WO | 2010012184 | 2/2010 |
| WO | 2010038016 | 4/2010 |
| WO | 2010083826 | 7/2010 |
| WO | 2010110505 | 9/2010 |
| WO | 2011071902 | 6/2011 |
| WO | 2011071907 | 6/2011 |
| WO | 2011071910 | 6/2011 |
| WO | 2011130063 | 10/2011 |
| WO | 2012015567 | 2/2012 |
| WO | 2012047370 | 4/2012 |
| WO | 2012071449 | 5/2012 |
| WO | 2012091984 | 7/2012 |
| WO | 2012149007 | 11/2012 |
| WO | 2012164236 | 12/2012 |
| WO | 2012174101 | 12/2012 |
| WO | 2012175665 | 12/2012 |
| WO | 2013019410 | 2/2013 |
| WO | 2013019421 | 2/2013 |
| WO | 2013053057 | 4/2013 |
| WO | 2013078031 | 5/2013 |
| WO | 2013109287 | 7/2013 |
| WO | 2013122712 | 8/2013 |
| WO | 2013154634 | 10/2013 |
| WO | 20131544634 | 10/2013 |
| WO | 2014100141 | 6/2014 |
| WO | 2014113058 | 7/2014 |
| WO | 2014121384 | 8/2014 |
| WO | 2014210283 | 12/2014 |
| WO | 2015127177 | 8/2015 |
| WO | 2015142862 | 9/2015 |
| WO | 2015161171 | 10/2015 |
| WO | 2015171126 | 11/2015 |
| WO | 2015171585 | 11/2015 |
| WO | 2016032490 | 3/2016 |
| WO | 2016032493 | 3/2016 |
| WO | 2016032619 | 3/2016 |
| WO | 2016032620 | 3/2016 |
| WO | 2016032621 | 3/2016 |
| WO | 2016032758 | 3/2016 |
| WO | 2016032761 | 3/2016 |
| WO | 2016036371 | 3/2016 |
| WO | 2016085798 | 6/2016 |
| WO | 2016165041 | 10/2016 |
| WO | 2020018110 | 1/2020 |
| WO | 2020109770 | 6/2020 |

OTHER PUBLICATIONS

Terves LLC, Response to First Office Action for China Patent Application No. 201580020103.7 (Official Translation dated Jul. 2, 2020).

Medlin, Dana, "Expert Report of Dana J. Medlin, Phd, PE, FASM in the Matter of *Terves LLC* v. *Yueyang Aerospace New Materials Co., Ltd., et al.* ", US District Court for the Northern District of Ohio, Eastern Division, Case No. 1:19-cv-1661 (Jul. 27, 2021.

Medlin, Dana,"Expert Rebuttal Report of Dana J. Medlin, Phd, PE, FASM", US District Court for the Northern District of Ohio, Eastern Division, Case No. 1:19-cv-1661 (Aug. 27, 2021).

(56) References Cited

OTHER PUBLICATIONS

Yueyang Aerospace New Materials Co, Ltd, et al, "The Ecometal Defendant's Final Invalidity, Non-Infringement, and Unenforceability Contentions", US District Court for the Northern District of Ohio, Eastern Division, Case No. 1:19-cv-1661 (Jul. 6, 2020 ).
Ralston and Birbilis, "Effect of Grain Size on Corrosion: A Review", Corrosion, vol. 66, No. 7, pp. 075005-01 thru 13 (2010).
Sherman, Andrew, "Declaration of Andrew J. Sherman Under 37 CFR § 1.132" in Ex Parte Reexamination of U.S. Appl. No. 90/014,795 (Jan. 14, 2021).
Swanger, Lee A., "Declaration of Lee A. Swanger, PhD, PE Under 37 CFR § 1.132" in Ex Parte Reexamination of U.S. Appl. No. 90/014,795 (Jan. 14, 2021).
Saravanan et al., "Fabrication and characterization of pure magnesium-30 vol SiCP particle composite", Material Science and Eng., vol. 276, pp. 108-116 (2000).
Song et al., Texture evolution and mechanical properties of AZ31B magnesium alloy sheets processed by repeated unidirectional bending, Journal of Alloys and Compounds, vol. 489, pp. 475-481 (2010).
Blawert et al., "Magnesium secondary alloys: Alloy design for magnesium alloys with improved tolerance limits against impurities", Corrosion Science, vol. 52, No. 7, pp. 2452-2468 (Jul. 1, 2010).
Wang et al., "Effect of Ni on microstructures and mechanical properties of AZ1 02 magnesium alloys" Zhuzao Foundry, Shenyang Zhuzao Yanjiusuo, vol. 62, No. 1, pp. 315-318 (Jan. 1, 2013).
Kim et al., "Effect of aluminum on the corrosions characteristics of Mg—4Ni—xAl alloys", Corrosion, vol. 59, No. 3, pp. 228-237 (Jan. 1, 2003).
Unsworth et al., "A new magnesium alloy system", Light Metal Age, vol. 37, No. 7-8., pp. 29-32 (Jan. 1, 1979).
Geng et al., "Enhanced age-hardening response of Mg—Zn alloys via Co additions", Scripta Materialia, vol. 64, No. 6, pp. 506-509 (Mar. 1, 2011).
Zhu et al., "Microstructure and mechanical properties of Mg6ZnCuO. 6Zr (wt.%) alloys", Journal of Alloys and Compounds, vol. 509, No. 8, pp. 3526-3531 (Dec. 22, 2010).
International Search Authority, International Search Report and Written Opinion for PCT/GB2015/052169 (dated Feb. 17, 2016).
Search and Examination Report for GB 1413327.6 (dated Jan. 21, 2015).
Magnesium Elektron Test Report (Mar. 8, 2005).
New England Fishery Management Counsel, "Fishery Management Plan for American Lobster Amendment 3" (Jul. 1989).
Emly, E.F., "Principles of Magnesium Technology" Pergamon Press, Oxford (1966).
Shaw, "Corrosion Resistance of Magnesium Alloys", ASM Handbook, vol. 13A, pp. 692-696 (2003).
Hanawalt et al., "Corrosion studies of magnesium and its alloys", Metals Technology, Technical Paper 1353 (1941).
The American Foundry Society, Magnesium alloys, casting source directory 8208, available at www.afsinc.org/files/magnes.pdf.
Rokhlin, "Magnesium alloys containing rare earth metals structure and properties", Advances in Metallic Alloys, vol. 3, Taylor & Francis (2003).
Ghali, "Corrosion Resistance of Aluminum and Magnesium Alloys" pp. 382-389, Wiley Publishing (2010).
Kim et al., "High Mechanical Strengths of Mg—Ni—Y and MG—Cu Amorphous Alloys with Significant Supercooled Liquid Region", Materials Transactions, vol. 31, No. 11, pp. 929-934 (1990).
Tekumalla et al., "Mehcanical Properties of Magnesium-Rare Earth Alloy Systems", Metals, vol. 5, pp. 1-39 (2014).
Hassan et al., "Development of high strength magnesium based composites using elemental nickel particulates as reinforcement", Journal of Materials Science, vol. 37, pp. 2467-2474 (2002).
Metals Handbook, Desk Edition, edited by J.R. Davis, published by ASM International, pp. 559-574 (1998).
National Physical Laboratory, "Bimetallic Corrosion" Crown (C) p. 1-14 (2000).
Shaw, "Corrosion Resistance of Magnesium Alloys", ASM Handbook, vol. 13A, pp. 602-606 (2003).
Ye et al., "Review of recent studies in magnesium matrix composites", Journal of Material Sciences, vol. 39, pp. 6153-6171 (2004).
Hassan et al., "Development of a novel magnesium-copper based composite with improved mechanical properties", Materials Research Bulletin, vol. 37, pp. 377-389 (2002).
Ye et al., "Microstructure and tensile properties of Ti6A14V/AM60B magnesium matrix composite", Journal of Alloys and Composites, vol. 402, 00. 162-169 (2005).
Kumar et al., "Mechanical and Tribological Behavior of Particulars Reinforced Aluminum metal Matrix Composite", Journal of Minerals & Materials Characterization and Engineering, vol. 10, pp. 59-91 (2011).
Majumdar, "Micromechanics of Discontinuously Reinforced MMCs", Engineering Mechanics and Analysis of Metal-Matrix Composites, vol. 21, pp. 395-406 (2001).
Hemanth, "Fracture Behavior of Cryogenically solidifed aluminum-alloy reinforced with Nano-ZrO2 Metal Matrix Composites (CNMMCs)", Journal of Chemical Engineering and Materials Science, vol. 2(8), pp. 110-121 (Aug. 2011).
Ashby, "Teach Yourself Phase Diagrams and Phase Transformations", Cambridge, 5th Edition, pp: unknown (Mar. 2009).
Callister, Materials Science and Engineering an Introduction:, 6th Edition, New York, pp: unknown (2003).
Hanson et al. Constitution of Binary Alloys:, McGraw-Hill Book Co. Inc., pp: unknown (1958).
MSE 2090: Introduction to Materials Science, Chapter 9, pp: unknown (date unknown).
Metals Handbook, "Metallography, Structures and Phase Diagrams", Aluminum-Magnesium, American Society for Metals, 8th Edition, vol. 8, pp: unknown (1973).
Metals Handbook, "Metallography, Structures and Phase Diagrams", Magnesium-Nickel, American Society for Metals, 8th Edition, vol. 8, pp: unknown (1973).
Principles and Prevention of Corrosion, "Volts versus saturated calomel reference electrobe", D.A. Jones, p. 170 (1996).
Medlin, "Mass Balance", handwritten notes (Nov. 2020).
Metals Handbook, "Metallography, Structures and Phase Diagrams", Aluminum-Iron, American Society for Metals, 8th Edition, vol. 8, p. 260 (1973).
Metals Handbook, "Metallography, Structures and Phase Diagrams", Aluminum-Nickel, American Society for Metals, 8th Edition, vol. 8, p. 261 (1973).
Metals Handbook, "Metallography, Structures and Phase Diagrams", Aluminum-Copper, American Society for Metals, 8th Edition, vol. 8, p. 259 (1973).
Metals Handbook, "Metallography, Structures and Phase Diagrams", Silver-Aluminum, American Society for Metals, 8th Edition, vol. 8, p. 252 (1973).
Medlin, Declaration of Dona J. Medlin Ph D., P.E., FASM Under 37 CFR Section 1.68 in Support of Petition for Inter Partes Review of U.S. Pat. No. 9,903,010 (Sep. 2020).
Li, Qiang, "Translation Declaration and Translation of China Patent Publication No. 103343271" (Jun. 2020).
Ho et al., The mechanical behavior of magnesium alloy AZ91 reinforced with fine copper particulates:, Materials Science and Engineering A369, pp. 302-308 (2004).
Trojanova et al., "Mechanical and fracture properties of an AZ91 Magnesium alloy reinforced by Si and SiC particles", Composites Science and Technology, vol. 69, pp. 2256-2264 (2009).
Lin et al., "Formation of Magnesium Metal Matrix Composites Al2O3p/AZ91D and Their Mechanical Properties After Heat Treatment" Acta Metallurgica Slovaca, vol. 16, pp. 237-245 (2010).
United States District Court/Northern District of Ohio/Eastern Division, Supplemental Declaration of Dana J. Medlin, Ph D. in Support of Opposition to Terves LLC'S Motion for Preliminary Injunction in related Case 1:19-CV-1611 (filedOct. 15, 2020).
United States District Court/Northern District of Ohio/Eastern Division, Declaration of Andrew Sherman in Support of Terves' Preliminary Injunction Motion in related Case 1:19-CV-1611 (filed May 1, 2020).

(56) References Cited

OTHER PUBLICATIONS

Sigworth et al. "Grain Refinement of Aluminum Castings Alloys" American Foundry Society; Paper 07-67; pp. 5-7 (2007).
Momentive, "Titanium Diborid Powder" condensed product brochure; retrieved from https /www.momentive.com/WorkArea/DownloadAsset.aspx?id+27489.; p. 1 (2012).
Durbin, "Modeling Dissolution in Aluminum Alloys" Dissertation for Georgia Institute of Technology; retrieved from https://smartech;gatech/edu/bitstream/handle/1853/6873/durbin_tracie_L_200505_phd.pdf> (2005).
Pegeut et al.., "Influence of cold working on the pitting corrosion resistance of stainless steel" Corrosion Science, vol. 49, pp. 1933-1948 (2007).
Elemental Charts from chemicalelements.com; retrieved Jul. 27, 2017.
Song et al., "Corrosion Mechanisms of Magnesium Alloys" Advanced Engg Materials, vol. 1, No. 1 (1999).
Zhou et al., "Tensile Mechanical Properties and Strengthening Mechanism of Hybrid Carbon Nanotubes . . . " Journal of Nanomaterials, 2012; 2012:851862 (doi: 10 1155/2012/851862) Figs. 6 and 7.
Trojanova et al., "Mechanical and Acoustic Properties of Magnesium Alloys . . . " Light Metal Alloys Application, Chapter 8, Published Jun. 11, 2014 (doi: 10.5772/57454) p. 163, para. [0008], [0014-0015]; [0041-0043].
AZoNano "Silicon Carbide Nanoparticles-Properties, Applications" http://www.amazon.com/articles.aspx?ArticleD=3396) p. 2, Physical Properties, Thermal Properties (May 9, 2013).
AZoM "Magnesium AZ91D-F Alloy" http://www.amazon.com/articles.aspx?ArticleD=8670) p. 1, Chemical Composition; p. 2 Physical Properties (Jul. 31, 2013.
Elasser et al., "Silicon Carbide Benefits and Advantages . . . " Proceedings of the IEEE, 2002; 906(6):969-986 (doi: 10.1109/JPROC.2002.1021562) p. 970, Table 1.
Lan et al., "Microstructure and Microhardness of SiC Nanoparticles . . . " Materials Science and Engineering A; 386:284-290 (2004).
Casati et al., "Metal Matrix Composites Reinforced by Nanoparticles", vol. 4:65-83 (2014).
United States District Court/Northern District of Ohio/Eastern Division, Memorandum Opinion and Order in related Case 1:19-CV-1611 (issued Mar. 29, 2021).
United States District Court/Northern District of Ohio/Eastern Division, Second Rebuttal Rule 26 Report of Lee A. Swanger, Ph.D., P.E. in related Case 1:19-CV-1611 (filed Nov. 24, 2020).
U.S. Patent and Trademark Office, Declaration of Dana J. Medlin in Support of Request for Ex Parte Reexamination of U.S. Pat. No. 10,329,653 (filed Jul. 6, 2021).
Shimizu et al., "Multi-walled carbon nanotube-reinforced magnesium alloy composites", Scripta Materialia, vol. 58, pp. 267-270 (2008).
Zhan et al., "Single-wall carbon nanotubes as attractive toughening agents in alumina-based nanocomposites", Mature Materials, vol. 2, pp. 38-42 (Jan. 2003).
Curtin et al., "CNT-reinforced ceramics and metals", Materials Today, vol. 7, pp. 44-49 (2004).
Pardo et al., "Corrosion behavior of magnesium/aluminum alloys in 3.5 wt.% NaCl", Corrosion Science, vol. 50, pp. 823-834 (2008).
Song et L., "Influence of microstructure on the corrosion of diecast AZ91D", Corrosion Science, vol. 41, pp. 249-273 (1999).
Watarai, "Trend of Research and Development for Magnesium Alloys—Reducing the Weight of Structural Materials in Motor Vehicles", Science & Technology Trends, Quarterly Review, No. 18, pp. 84-97 (Jan. 2006).
Saravanan et al., "Mechanically Alloyed Carbon Nanotubes (CNT) Reinforced Nanocrystalline AA 4032: Synthesis and Characterization", Journal of Minerals & Materials Characterization & Engineering, vol. 9, No. 11, pp. 1027-1035 (2010).
Tsipas et al., "Effect of high energy ball milling on titanium-hydroxyapatite powders", Powder Metallurgy, vol. 46, No. 1 pp. 73-77 (2003).
Xie et al., "TEM Observation of Interfaces between Particles in Al—Mg Powder Compacts Prepared by Pulse Electric Current Sintering", Materials Transactions, vol. 43, No. 9, pp. 2177-2180 (2002).
Elsayed et al., "Effect of Consolidation and Extrusion Temperatures on Tensile Properties of Hot Extruded ZK61 Magnesium Alloy Gas Atomized Powders via Spark Plasma Sintering", Tranasctions of JWRI, vol. 38, No. 2, pp. 31.
Shigematsu et al., "Surface treatment of AZ91D magnesium alloy by aluminum diffusion coating", Journal of Materials Science Letters, vol. 19, pp. 473-475 (2000).
Spencer et al., "Fluidized Bed Polymer Particle ALD Process for Producing HDPE/Alumina Nanocomposites", 12th International Conference on Fluidization, vol. RP4 (2007).
Maisano, "Cryomilling of Aluminum-Based and Magnesium-Based Metal Powders", Thesis, Virginia Tech (Jan. 2006).
Walters et al., "A Study of Jets from Unsintered-Powder Metal Lined Nonprecision Small-Caliber Shaped Charges", Army Research Laboratory, Aberdeen Proving Group, MC 21005-5066 (Feb. 2001).

* cited by examiner

FLUID ACTIVATED DISINTEGRATING METAL SYSTEM

The present invention is a continuation application of Serial No. U.S. application Ser. No. 16/110,550 filed Aug. 23, 2018, which in turn is a continuation of U.S. application Ser. No. 14/627,189 filed Feb. 20, 2015 (now U.S. Pat. No. 10,150,713 on Dec. 11, 2018), which in turn claims priority on U.S. Provisional Application Ser. No. 61/942,870 filed Feb. 21, 2014 and 62/054,597 filed Sep. 24, 2014, both of which are incorporated herein by reference.

FIELD OF THE INVENTION

The present invention relates to the formation of disintegrating components and materials that can be stored indefinitely or near indefinitely unless activated. The present invention also relates to the production of a reactive composite having controlled reaction kinetics catalyzed by an external stimulus. The invention further relates to a reactive composite system that is inert unless initiated by a certain temperature, pH, and/or other external stimulus after, which it disintegrates in a controlled and repeatable manner.

BACKGROUND OF THE INVENTION

Reactive materials, which dissolve or corrode when exposed to acid, salt, or other wellbore conditions, have been proposed for some time. Generally, these consist of materials that are engineered to dissolve or corrode. Dissolving polymers have been disclosed and are also used extensively in the pharmaceutical industry for controlled-release drugs. In addition, reactive metal matrix composites have been proposed for use in disintegrating metallic systems, primarily consisting of magnesium-graphite systems, but also magnesium-calcium and other material systems that do not passivate and hence corrode in a rapid manner when in contact with a cathode material, such as graphite or iron.

While some of these systems have enjoyed modest success in reducing well completion costs, they have significant drawbacks, including limited strength and poor reliability, Ideally, components could be used, stored, and handled for long periods of time prior to use and, once activated, can undergo highly reliable disintegration or some other action.

SUMMARY OF THE INVENTION

The present invention relates to the formation of disintegrating components and materials that can be stored for long periods of time (e.g., at least a month, at least a year, etc.) unless activated. The present invention also relates to the production of a reactive composite having controlled reaction kinetics that can be catalyzed by an external stimulus. The invention further relates to a reactive composite system that is inert or essentially inert unless initiated by a certain temperature, pH, and/or other external stimulus after which it disintegrates in a controlled and repeatable manner. In one non-limiting application of the present invention, the components of the present invention can be used in the forming of wells used in, but not limited to, the oil and gas fracking industry. During the formation of wells, various metal components used to form the well are left in the well. These components must either be removed from the well or destroyed before the well can be fully and/or properly operational. The present invention is directed to components that can be used during the well forming operation and, once the component has completed its intended used, the component can be caused to disintegrate and/or fracture, thus sufficiently removing and/or fracturing the component so that the well can be fully and/or properly operational.

In one non-limiting aspect of the present invention relates to a hierarchically-designed component or system that includes a core and a surface which are designed to react and/or activate under different conditions. The core material is designed to have a high reaction rate that disintegrates over a period of 0.001 minutes to 100 hours (e.g., 0.001 min., 0.0011 min., 0.0012 min. . . . 99.99998 hours, 99.99999 hours, 100 hours, and all time values and ranges therebetween), and typically 30 minutes to 100 hours when exposed to certain environments (e.g., saltwater, electrolyte solutions, water, air, electromagnetic waves, sound waves, etc.). The core is typically designed to generate heat when exposed to various environments (e.g., saltwater, electrolyte solutions, water, air, electromagnetic waves, sound waves, etc.). The core can be formed of one or more layers. The shape of the core is non-limiting. The core is partially or fully surrounded by one or more surface or protective layers that inhibits or prevents the core from reacting and/or disintegrating until a desired time or event. The one or more surfaces or protective layers are designed to be inert unless exposed to an activation conditions such as, but not limited to, temperature, electromagnetic waves, sound waves, certain chemicals, and/or pH. Once the one or more surface or protective layers are removed and/or breached, the core material is activated to cause it to dissolve, corrode, react, fracture, etc. when exposed to certain surrounding conditions. For example, in a well application, the component is partially or fully submersed in a liquid environment that commonly includes water and/or saltwater/electrolytes. The core can be designed to dissolve, corrode, react, fracture, etc. when exposed to the water and/or to saltwater/electrolytes (e.g., HCl, KCl, $CaCl_2$, $CaBr_2$, $ZnBr_2$, brine solutions) in the well once the one or more surface or protective layers about the core are removed and/or breached, thereby causing the component to dissolve or disintegrate in the well. The one or more surface or protective layers can also or alternatively be used to provide structural strength to the hierarchically-designed component.

In another non-limiting aspect of the present invention, the hierarchically-designed component or system can include one or more outer surface or protective layers and a core that is formed of two or more layers. Each layer can have a different function in the component or system; however, this is not required. In one non-limiting configuration, the component or system can include a surface or protective layer that encapsulates a core which is formed of at least two layers. In such an arrangement, the inner layer of the core can be a syntactic or very low-density core; the layer about the inner core layer can be a disintegrating high-strength functional layer; and the surface or protective layer is one or more layers that function as a surface modification layer and/or treatment which is inert unless activated.

In still another non-limiting aspect of the present invention, there is provided a surface-inhibited multilayer, multifunctional component comprising (a) a primary or core unit which includes one or more selected properties of density, dissolution rate, disintegration rate, reaction rate, strength; (b) a reactive surface layer having a complimentary set of properties of one or more of strength, temperature-dependent solubility, pH solubility, and density; and wherein the core unit and surface layer create an inhibited system that is relatively inert until exposed to an initial condition, after which it is activated. In one non-limiting embodiment, at least 70 weight percent of the core includes a core material selected from the group consisting of a metal, a metal alloy or a metal composite, typically at least 90 weight percent of the core includes a core material selected from the group consisting of a metal, a metal alloy or a metal composite, more typically at least 95 weight percent of the core includes a core material selected from the group consisting of a metal, a metal alloy or a metal composite, and even more typically 100 weight percent of the core includes a core material selected from the group consisting of a metal, a metal alloy or a metal composite. The core can be a magnesium, magnesium alloy or magnesium composite having a dissolution rate in salt-containing water of 0.1-100 mm/hr (e.g., 0.1 mm/hr, 0.101 mm/hr, 0.102 mm/hr 99.998 mm/hr, 99.999 mm/hr, 100 min/hr and all dissolution values and ranges therebetween) at 100-300° F. (and all temperature values and ranges therebetween). When the core is formed of magnesium, the core includes at least 99 wt % magnesium, and typically at least 99.5 wt % magnesium. When the core is formed of a magnesium alloy, the magnesium content of the magnesium alloy is at least 30 wt %, typically greater than 50%, and more typically at least about 70%. The metals that can be included in the magnesium alloy can include, but are not limited to, aluminum, calcium, lithium, manganese, rare earth metal, silicon, SiC, yttrium, zirconium and/or zinc. As can be appreciated, the core can be formed of other metals and/or non-metals that react, corrode, dissolve or disintegrate at a rate of 0.1-100 min/hr at 100-300° F. in water or salt water. Non-limiting examples of metals or metal alloys other than magnesium that can be used include aluminum alloys (e.g., aluminum alloys including 75+% aluminum and one or more of bismuth, copper, gallium, magnesium, indium, silicon, tin, and/or zinc); calcium; Ca—Mg, Ca—Al; and Ca—Zn. The core can be formulated and/or designed to be relatively insoluble at one temperature (e.g., room temperature: 60-80° F.), but highly soluble above a certain temperature (e.g., 100° F. or greater). Likewise, the core can also or alternatively be formulated and/or designed to be relatively insoluble in a solution having a certain pH (e.g., acidic pH, basic pH, etc.), but highly soluble in a solution having a different pH. When the component includes a surface coating, the surface coating can be designed to be relatively insoluble at a first temperature (e.g., room temperature, etc.), but highly soluble above or below above the first temperature. The surface layer can be formed of a metal coating (e.g., zinc, zinc alloy, etc.) and/or a polymer coating. In one non-limiting example, a surface layer that is relatively insoluble has a dissolution rate of about 0-0.1 mm/day (all dissolution values and ranges therebetween). In another non-limiting example, a surface layer that is highly soluble has a dissolution rate of 0.1 mm/hr or greater (e.g., 0.1 mm/hr 50 mm/hr and all dissolution values and ranges therebetween). Likewise, the surface layer (when used) can also or alternatively be formulated and/or designed to be relatively insoluble in a solution having a certain pH (e.g., acidic pH, basic pH, etc.), but highly soluble in a solution having a different pH. Non-limiting examples of polymers that can be used include ethylene-α-olefin copolymer; linear styrene-isoprene-styrene copolymer; ethylene-butadiene copolymer; styrene-butadiene-styrene copolymer; copolymer having styrene endblocks and ethylene-butadiene or ethylene-butene midblocks; copolymer of ethylene and alpha olefin; ethylene-octene copolymer; ethylene-hexene copolymer; ethylene-butene copolymer; ethylene-pentene copolymer; ethylene-butene copolymer; polyvinyl alcohol (PVA); and/or polyvinyl butyral (PVB). Also or alternatively, when the component includes a surface layer, the surface layer can include a chemistry that enables the surface layer to be an insoluble layer and then become a soluble layer when reacted with one or more compounds. For example, when the surface layer includes PVA, PVB, and/or similar polymers, the surface layer can be modified using a reversible chemical reaction to be insoluble in high-temperature water, acidic water solutions and/or salt water solutions, and which is soluble in high-temperature water, acidic water solutions and salt water solutions when a chemical trigger is applied. The reversible chemical reaction to make the surface layer insoluble can use trimethylsilyl group or similar silicon-containing organic chemicals. The reversible chemical reaction to make the surface layer soluble again can use ammonium fluoride or a similar compound. This non-limiting type of reversible chemistry is illustrated below:

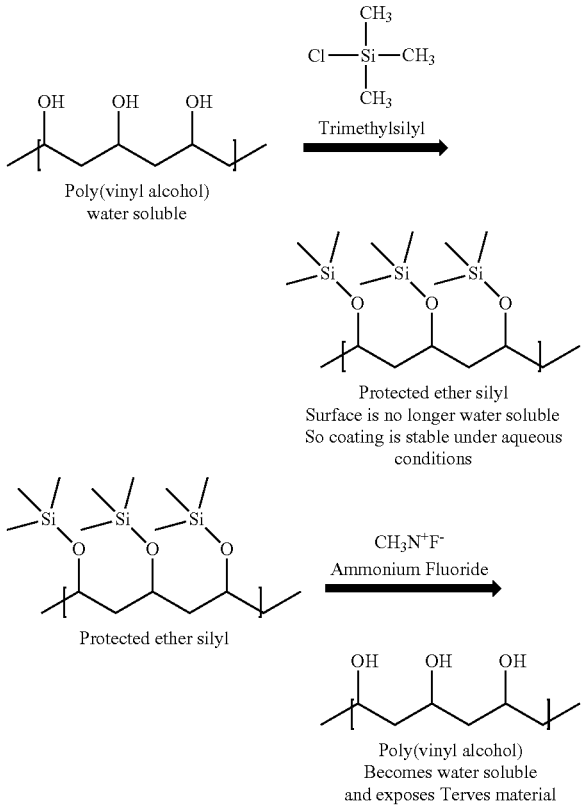

As set forth above, PVA, a compound that is soluble in water, can be made insoluble in water by reacting the PVA with trimethylsilyl group or some similar compound to form an insoluble compound in water. This reaction can take place prior to, during, and/or after the PVA (i.e., surface layer) is applied to the core of the component. The core of the component or a portion of the core of the component can be formed of a material (e.g., magnesium, magnesium alloy, etc.) that reacts, corrodes, dissolves, fractures, etc. when exposed to water. The modified surface layer that is insoluble to water protects the core from the water and inhibits or prevents the core from interacting with the water while the component is being used in the presence of water. Once the function or task of the component is completed, the component can be simply dissolved, corroded, fractured, disintegrated, etc. by exposing the water-insoluble surface layer to ammonium fluoride or a similar compound. Such exposure causes the surface layer to once again become a water-soluble compound. When the component is in the presence of water, the surface layer dissolves and the core is eventually exposed to the water. Upon exposure to water, the core dissolves, corrodes, fractures, disintegrates, etc. thereby causing the component to also dissolve, fracture, corrode, disintegrate, etc. The thickness of the surface layer and/or degree of solubility of the surface layer can be selected to control the rate at which the component dissolves, corrodes, fractures, disintegrates, etc. Likewise, the type of material used for the core and/or structure of the core can be selected to control the rate at which the component dissolves, corrodes, fractures, disintegrates, etc.

In yet another non-limiting aspect of the present invention, the surface layer can optionally be formed of a material that that resists degradation and/or dissolving when exposed to HCl (e.g., 0.1-3M HCl), KCl (e.g., 0.1-3M KCl), $CaCl_2$ (e.g., 0.1-3M $CaCl_2$), $CaBr_2$ (e.g., 0.1-3M $CaBr_2$), $ZnBr_2$ (e.g., 0.1-3M $ZnBr_2$), or brine solutions (1000-300,000 ppm) at a temperature of up to 60° F., but degrades and/or dissolves at a higher temperature of at least 100° F. In one specific surface layer, the surface layer resists HCl, KCl, and/or brine solutions up to 300° F., but degrades when a trigger (e.g., chemical ion source, fluorine ion source, etc.) is introduced to the solution in contact with the coating. One such coating is silicone-based coating (e.g., polymer-based siloxane two-part coating, 2-part epoxy-siloxane coating cured with amino silane, etc.). When the trigger is a fluorine ion source, the source of the fluorine ion can optionally be HF, ammonium fluoride, or other ionic compound where the fluorine ion will appear in a water solution.

In still yet another non-limiting aspect of the present invention, the surface layer can be applied to the core in a variety of ways (gas deposition, sublimation, solvent application, powder coating, plasma spraying, spraying, dipping, brushing, etc.).

In another non-limiting aspect of the present invention, the surface layer can be a polyurethane base system.

In still another non-limiting aspect of the present invention, the surface layer can be colored using dies for identification of the type of coating, type of core, type of trigger required, and/or type of hierarchically-designed component or system. In one non-limiting coating application process, an electrostatic coating and thermal curing using either a thermoset or thermoplastic polymer coating is used. Such a coating process is known in the industry as a type of "powder coating."

In still yet another non-limiting aspect of the present invention, there is provided a hierarchically-designed component or system in the form of a low-density reactive hierarchically-designed component or system that includes (a) a core having a compression strength above about 5000 psig (e.g., 5000-30,000 psig and all values or ranges therebetween), but having a low density and tensile strength below 30,000 psig (e.g., magnesium composite, aluminum composite, manganese composite, zinc composite, etc.); and (b) a high-strength surface layer that has a higher density and higher strength than the core, but is also reactive (e.g., zinc or zinc alloy composite, etc.) and wherein the core and surface layer are designed to provide a high strength reactive system that also has an overall density of no more than about 5 glee (e.g., 0.5-5 g/cc and all values and ranges therebetween) and a tensile strength in the surface layer at least 32 ksi (e.g., 32-90 ksi and all values and rages therebetween). In one non-limiting configuration, the core has a density of about 0.9-1.4 g/cc. When the core is a magnesium composite, aluminum composite, manganese composite, or a zinc composite, the core can be formed of particles that are connected together by a binder. The core particles can include iron particles, carbon particles, tungsten particles, silicon particles, boron particles, tantalum particles, aluminum particles, zinc particles, iron particles, copper particles, molybdenum particles, silicon particles, ceramic particles, cobalt particles, nickel particles, rhenium particles, SiC particles, etc. (includes oxides and carbides thereof) having an average particle diameter size of about 5 to 50 microns (e.g., 5 microns, 5.01 microns, 5.02 microns . . . 49.98 microns, 49.99 microns, 50 microns) and any value or range therebetween, that are coated with about 0.3 to 3 microns coating thickness (e.g., 0.3 microns, 0.301 microns, 0.302 microns . . . 2.998 microns, 2.999 microns, 3 microns) and any value or range therebetween, of a matrix of magnesium, magnesium alloy, aluminum, aluminum alloy, manganese, manganese alloy, zinc and/or zinc alloy. The magnesium composite, aluminum composite, manganese composite, or zinc composite can be formulated to react when activated by an electrolyte (e.g., HCl, KCl, $CaCl_2$, $CaBr_2$, $ZnBr_2$, or brine solutions), heat, etc., with the reactive binder dissolving at a controlled rate. In one non-limiting configuration, the surface layer is a high-strength zinc alloy. In another non-limiting configuration, the core can have a dissolution rate in salt-containing water of 0.1-100 mm/hr at 100-300° F. In another non-limiting configuration, the surface layer can include a fiber-reinforced metal (e.g., steel wire, graphite fiber reinforced magnesium, etc.) to obtain the desired strength of the surface layer.

In another non-limiting aspect of the present invention, there is provided a reactive hierarchically-designed component or system that includes (a) a core having an active material, and a material that is reactive in a fluid; (b) a selectively reactive surface layer that is unreactive in the a first fluid or first fluid conditions, but dissolves or reacts in a second fluid or a condition different from the first fluid condition; and wherein the core is coated with the selectively reactive surface layer, and wherein the core is formed of a different material from the selectively reactive surface layer, and the coating thickness of the selectively reactive surface layer is less than a diameter of the core. The core can include propellant. In one non-limiting configuration, the core includes a water-reactive material such as lithium, sodium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, divalent cation alanates, and/or other water-reactive materials. The surface layer is formulated to protect or insulate the core from external environments wherein the core would be reactive to the external environment. In one non-limiting configuration, the coating is insoluble at room temperature, but soluble at a higher temperature. In another or alternative non-limiting configuration, the surface is or includes PVA or PVB. In another and/or alternative non-limiting configuration, the core includes a reactive binder having a metal fuel and/or oxidizer composite which includes one or more of the following metals: magnesium, zirconium, tantalum, titanium, hafnium, calcium, tungsten, molybdenum, chrome, manganese, silicon, germanium and/or aluminum that is mixed with an oxidizer or thermite pair (e.g., fluorinated or chlorinated polymers such as polytetrafluoroethylene, polyvinylidene difluoride, oxidizers such as bismuth oxide, potassium perchlorate, potassium or silver nitrate, iron oxide, tungsten or molybdenum oxide, and/or intermetallic thermite such as boron, aluminum, or silicon). In another and/or alternative non-limiting configuration, the binder can include an intermetallic reactive material such as iron-aluminum, nickel-aluminum, titanium-boron, and/or other high energy intermetallic couple. In another and/or alternative non-limiting configuration, the binder can include a fuel, oxidizer, and/or a reactive polymeric material. In another and/or alternative non-limiting configuration, the reactive polymeric material can include aluminum-potassium perchlorate-polyvinylidene difluoride and/or tetrafluoroethylene (THV) polymer. The core can be formed by powder metallurgy techniques (e.g., solid state powder sinter-forging, solid state sinter-extrusion, and spark plasma or field assisted sintering in the solid or semi-solid state). The core can alternatively be formed from melt casting, with or without subsequent deformation and heat treatment. The reactive hierarchically-designed component or system can be used to form a variety of structural components (e.g., valve, plug, ball, sleeve, casing etc.) that are designed to corrode/disintegrate or deflagrate under a controlled external stimulus. The reactive hierarchically-designed component or system can be designed to disintegrate over a controlled period of one hour to three weeks (and all values and ranges therebetween), and/or equivalently at a rate of about 0.05-100 mm/hr upon the imparting of a controlled external stimulus of pH, salt content, electrolyte content, electromagnetic waves, sound waves, vibrations, magnetism, pressure, electricity, and/or temperature. The reactive hierarchically-designed component or system can be designed to deflagrate or otherwise combust or react over a certain time period (e.g., one second to 24 hours and all time values or ranges therebetween) upon exposure to an external trigger (e.g., electrical, thermal, magnetic, or hydraulic signal). The trigger can optionally be direct or through a secondary interaction such as, but not limited to, piezoelectric device, breakable capsule, timer, or other intermediate device to convert an external signal to an initiation electrical and/or thermal event. The deflagration of the reactive hierarchically-designed component or system can be utilized to provide thermal energy, clear obstructions, and/or provide local pressure to a location about the hierarchically-designed component or system in a controlled manner. The reaction of the reactive hierarchically-designed component or system can optionally be designed to generate a physical dimensional change, such as swelling (change in density), deformation, bending, and/or shrinkage in the hierarchically-designed component or system during the reaction. In non-limiting application of the reactive hierarchically-designed component or system, composite matrix material and consolidation process used to form the core and/or the complete structure of the hierarchically-designed component or system can be used to enable simultaneous control of compression yield strength and/or control of compressibility modulus for crush and/or extrusion resistance when the hierarchically-designed component or system is contained in an entrapping orifice, and simultaneously also allow for control over the triggering event and the reaction rate of the reactive hierarchically-designed component or system.

In still another non-limiting aspect of the present invention, there is provided a reactive hierarchically-designed component or system that includes a) a core, the core dissolvable, reactive, or combinations thereof in the presence of a fluid environment; and, h) a surface layer that partially or fully encapsulates the core, and wherein the surface layer has a different composition from the core, and wherein the surface layer forms a protective layer about the core to inhibit or prevent the core from dissolving, reacting, or combinations thereof when the component is exposed to the fluid environment, and wherein the surface layer is non-dissolvable in the fluid environment until the surface layer is exposed to an activation event which thereafter causes the surface layer to controllably dissolve and/or degrade in the fluid environment, and wherein the core dissolving, reacting, or combinations thereof after the surface layer dissolves and exposes the core to the fluid environment. At least 70 weight percent of the core optionally includes one or more core materials selected from the group consisting of a metal, a metal alloy, a metal composite and a metal compound. The core material optionally including one or more metals or compounds selected from the group consisting of aluminum, calcium, lithium, magnesium, potassium, sodium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, and divalent cation alanates. The fluid environment optionally is a water-containing environment. The activation event optionally includes one or more events selected from the group consisting of a temperature change of the fluid environment, a pH change of the fluid environment, exposure of the surface layer with an activation compound, a change in composition of fluid environment, exposure of the surface layer to an electrical charge, exposure to of the surface layer to certain electromagnetic waves, a change in salt content of the fluid environment, a change in electrolyte content of the fluid environment, exposure of the surface layer to certain sound waves, exposure of the surface layer to certain vibrations, exposure of the surface layer to certain magnetic waves, and exposure of the surface layer to a certain pressure. The core optionally has a dissolution rate in the fluid environment of 0.1 and 100 mm/hr at 100-300° F. The surface layer is optionally formulated to be relatively insoluble at a first temperature in the fluid environment and highly soluble in the fluid environment at a second temperature. The surface layer is optionally formulated to be relatively insoluble at a first pH in the fluid environment and highly soluble in the fluid environment at a second pH. The surface layer optionally is chemically modified using a reversible chemical reaction to be insoluble in the fluid environment and soluble in the fluid environment when the chemically modified surface layer is exposed to a chemical compound that is a chemical trigger. The surface layer is optionally chemically modified with a silicon-containing compound. The chemical trigger is optionally a fluorine ion source. There is optionally provided a method for forming the reactive hierarchically-designed component or system as set forth above. There is optionally a method for forming the reactive hierarchically-designed component or system into a structure that can be used for a) separating hydraulic fracturing systems and zones for oil and gas drilling, b) structural support or component isolation in oil and gas drilling and completion systems, or combinations thereof.

In yet another non-limiting aspect of the present invention, there is provided a reactive hierarchically-designed component or system that includes (a) a core having a compression strength above 5000 psig, a density of no more than 1.7 glee and a tensile strength of less than 30,000 psig; (b) a high-strength surface layer that has a greater density and higher strength than the core, the surface layer partially of fully encapsulating the core; and wherein the core and the surface layer are provide a high-strength reactive system that also has an overall lower density than approximately 4 glee and a strength in the surface layer of at least 35 ksi. The core is optionally a magnesium composite or aluminum composite having a density of 0.9-1.4 g/cc. The surface layer is optionally a zinc alloy. The core optionally has a dissolution rate in a salt water environment of 0.1 and 100 mm/hr at 100-300° F. The surface layer optionally includes a fiber-reinforced metal. There is optionally provided a method for forming the reactive hierarchically-designed component or system as set forth above. There is optionally a method for forming the reactive hierarchically-designed component or system into a structure that can be used for a) separating hydraulic fracturing systems and zones for oil and gas drilling, b) structural support or component isolation in oil and gas drilling and completion systems, or combinations thereof.

In still yet another non-limiting aspect of the present invention, there is provided a reactive hierarchically-designed component or system that includes (a) a core that includes an active material that is reactive in a fluid environment; (b) a propellant located in she core, about the core, or combinations thereat and, (c) a surface layer that partially or fully encapsulates the core, the propellant, or combinations thereof, and wherein the surface layer has a different composition from the core and the propellant, and wherein the propellant has a different composition from the core, and wherein the surface layer forms a protective layer about the core and the propellant to inhibit or prevent the core and the propellant from dissolving, reacting, or combinations thereof when the component is exposed to the fluid environment, and wherein the surface layer is non-dissolvable in the fluid environment until the surface layer is exposed to an activation event which thereafter causes the surface layer to controllably dissolve and/or degrade in the fluid environment and the core and the propellant dissolving, reacting, or combinations thereof after the surface layer dissolves and/or degrades and exposes the core and/or the propellant to the fluid environment. The propellant optionally includes one or more water-reactive material selected from the group consisting of lithium, sodium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, divalent cation alanates, and/or other water-reactive materials. The reaction of the propellant with the fluid environment optionally causes rapid heat generation which in turn causes the core to ignite. The fluid environment optionally is a water-containing environment. The activation event optionally includes one or more events selected from the group consisting of a temperature change of the fluid environment, a pH change of the fluid environment, exposure of the surface layer with an activation compound, a change in composition of fluid environment, exposure of the surface layer to an electrical charge, exposure to of the surface layer to certain electromagnetic waves, a change in salt content of the fluid environment, a change in electrolyte content of the fluid environment, exposure of the surface layer to certain sound waves, exposure of the surface layer to certain vibrations, exposure of the surface layer to certain magnetic waves, and exposure of the surface layer to a certain pressure. The surface layer is optionally formulated to be relatively insoluble at a first temperature in the fluid environment and highly soluble in the fluid environment at a second temperature. The surface layer is optionally formulated to be relatively insoluble at a first pH in the fluid environment and highly soluble in the fluid environment at a second pH. The surface layer is optionally chemically modified using a reversible chemical reaction to be insoluble in the fluid environment and soluble in the fluid environment when the chemically-modified surface layer exposed to a chemical compound that is a chemical trigger. The surface layer optionally is chemically modified with a silicon containing compound. The chemical trigger is optionally a fluorine ion source. The core optionally includes a metal fuel and oxidizer composite which includes one or more mixtures of a reactive metal, an oxidizer, or thermite pair, the reactive metal including one or more metals selected from the group consisting of magnesium, zirconium, tantalum, titanium, hafnium, calcium, tungsten, molybdenum, chrome, manganese, silicon, germanium and aluminum, the oxidizer or thermite pair including one or more compounds selected from the group consisting of fluorinated or chlorinated polymer, oxidizer, and intermetallic thermite. The core optionally includes a binder that includes an intermetallic reactive material that includes a metal material selected from the group consisting of iron-aluminum, nickel-aluminum, titanium-boron, high energy intermetallic couple, or combinations thereof. The binder optionally includes a fuel, an oxidizer, and a reactive polymeric material. The reactive polymeric material optionally includes aluminum-potassium perchlorate-polyvinylidene difluoride or tetrafluoroethylene (THY) polymer. There is optionally provided a method for forming the reactive hierarchically-designed component or system as set forth above. There is optionally a method for forming the reactive hierarchically-designed component or system into a structure that can be used for a) separating hydraulic fracturing systems and zones for oil and gas drilling, b) structural support or component isolation in oil and gas drilling and completion systems, or combinations thereof.

In another non-limiting aspect of the present invention, there is provided a reactive hierarchically-designed component or system that is formed in to structural material that is designed to corrode/disintegrate or deflagrate under a controlled external stimulus. The structural material is optionally designed to disintegrate over a controlled period of one hour to one month or at a rate of about 0.1 to 100 mm/hr upon the imparting of a controlled external stimulus to the structural component. The structural material is optionally designed to deflagrate or otherwise combust or react over a one-second to one-hour period upon an external trigger, and wherein the deflagration is utilized to provide thermal energy, clear obstructions, provide local pressure, or combinations thereof in a controlled manner. The reaction is optionally designed to generate a physical dimensional change, deformation, bending, shrinkage, or combinations thereof.

In one non-limiting object of the present invention, there is provided a component or system that can be controllably disintegrated.

In another and/or alternative non-limiting object of the present invention, there is provided a component or system that can be used in a well operation that can be controllably disintegrated.

In still another and/or alternative non-limiting object of the present invention, there is provided a component or system that can include a core material having a surface or protective layer and which component or system can be stored for long periods of time unless activated.

In yet another and/or alternative non-limiting object of the present invention, there is provided a component or system that can include a core material having a surface or protective layer and which component or system has controlled reaction kinetics that can be catalyzed by an external stimulus.

In still yet another and/or alternative non-limiting object of the present invention, there is provided a component or system that can include a core material having a surface or protective layer and which component or system has a reactive composite system that is inert or essentially inert unless initiated by a certain temperatures, electromagnetic waves, sound waves, vibrations, chemicals, liquids, gasses, electromagnetic waves, pH, salt content, exposure electrolyte content, magnetism, pressure, and/or exposure to electricity and/or other external stimulus after which it disintegrates in a controlled and repeatable manner.

In another and/or alternative non-limiting object of the present invention, there is provided a component or system that can include a core material having a surface or protective layer and which component or system has a hierarchically-designed component or system that includes a core and a surface which are designed to react and/or activate under different conditions.

In still another and/or alternative non-limiting object of the present invention, there is provided a component or system that can include a core material having a surface or protective layer and which component or system has a core material is designed to have a high reaction rate that disintegrates when exposed to certain environments (liquids, gasses, temperatures, electromagnetic waves, vibrations, and/or sound waves, pH, salt content, electrolyte content, magnetism, pressure, and/or temperature, etc.).

In yet another and/or alternative non-limiting object of the present invention, there is provided a component or system that can include a core material having a surface or protective layer and which component or system has a core material is designed to generate heat when exposed to various environments (e.g., liquids, gasses, temperatures, electromagnetic waves, vibrations, and/or sound waves, pH, salt content, electrolyte content, magnetism, pressure, electricity, and/or temperature, etc.).

In still yet another and/or alternative non-limiting object of the present invention, there is provided a component or system that can include a core material having a surface or protective layer and which component or system has a core material is formed of one or more layers.

In another and/or alternative non-limiting object of the present invention, there is provided a component or system that can include a core material having a surface or protective layer and which component or system has a core material that is partially or fully surrounded by one or more surface or protective layers that inhibits or prevents the core from reacting and/or disintegrating until a desired time or event.

In still another and/or alternative non-limiting object of the present invention, there is provided a component or system that can include a core material having a surface or protective layer and which component or system has one or more surfaces or protective layers that are designed to be inert unless exposed to an activation event or condition, which activation event or condition could be, but are not limited to, temperature, electromagnetic waves, sound waves, certain chemicals, and/or pH.

In yet another and/or alternative non-limiting object of the present invention, there is provided a component or system that can include a core material having a surface or protective layer and in which each layer of the component or system has a different function in the component or system.

In still yet another and/or alternative non-limiting object of the present invention, there is provided a component or system that can be used as a dissolvable, degradable and/or reactive structure in oil drilling. For example, the component or system of the present invention can be used to form a frac ball or other structure in a well drilling or completion operation such as a structure that is seated in a hydraulic operation that can be dissolved away after use so that that no drilling or removal of the structure is necessary. Other types of structures can include, but are not limited to, sleeves, valves, hydraulic actuating tooling and the like. Such non-limiting structures or additional non-limiting structure are illustrated in U.S. Pat. Nos. 8,905,147; 8,717,268; 8,663,401; 8,631,876; 8,573,295; 8,528,633; 8,485,265; 8,403,037; 8,413,727; 8,211,331; 7,647,964; US 2013/0199800; US 2013/0032357; US 2013/0029886; US 2007/0181224; and WO 2013/122712; all of which are incorporated herein by reference.

These and other objects, features and advantages of the present invention will become apparent in light of the following detailed description of preferred embodiments thereof, as illustrated in the accompanying drawings.

DETAILED DESCRIPTION OF THE INVENTION

Referring now to the figures wherein the showings illustrate non-limiting embodiments of the present invention, the present invention is directed to the formation and use of disintegrating components and materials that can be stored for long periods of time until activated. The present invention also relates to the production of a reactive hierarchically-designed component or system having controlled reaction kinetics that can be catalyzed by an external stimulus. The invention further relates to a reactive hierarchically-designed component or system that is inert or essentially inert unless initiated by a certain temperature, pH, and/or other external stimulus after which it disintegrates in a controlled and repeatable manner. The components of the present invention have particular applicability to components used in the forming of wells; however, it will be appreciated that the components of the present invention can be used in many other industries and applications.

Figure 1:
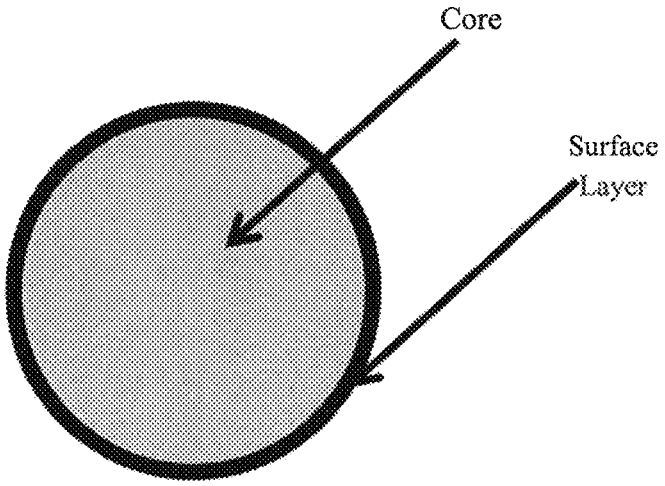
FIGS. 1-2 are a cross-sectional illustration of layered ball actuators in accordance with the present invention wherein the core represents a disintegrating high strength material.
Figure 2:
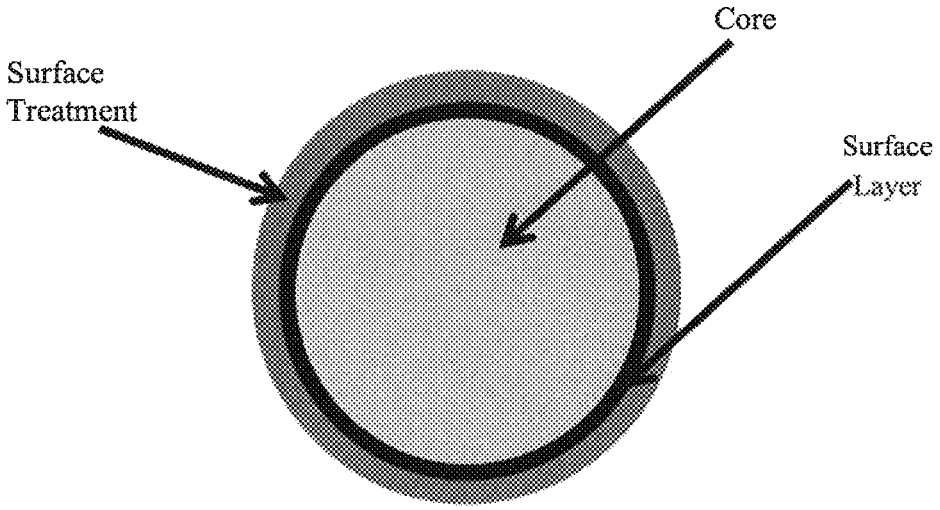

Referring to FIGS. 1-2, there are cross-sectional illustrations of layered composite ball actuators in accordance with the present invention wherein the core represents a disintegrating high strength composite. The cross-sectional shape of the core illustrated as being circular; however, it can be appreciated that the core can have any shape.

In one non-limiting configuration, the core can be formed of a metal such as, but not limited to, lithium, sodium, magnesium, magnesium-carbon-iron composite system, and the like. As can be appreciated, the core can also or alternatively include a polymer material. The core can be formed or more than one type of material; however, that is not required. The core can be formed of one or more layers. When the core includes two or more layers, the layers are generally formed of different materials; however, this is not required. The surface layer of the composite ball actuator can include a protective or delay coating. The surface layer can be a metal layer, a polymer layer, and/or a ceramic layer. The surface layer can be formed of one or more layers. When the surface layer includes two or more layers, the layers are generally formed of different materials; however, this is not required.

In one non-limiting arrangement, the surface layer can be a temperature-sensitive polymer such as, but not limited to, PVA, that is inert and insoluble until exposed to certain environmental conditions. For example, when the surface layer is PVA, and when the PVA reaches a critical temperature in water, the PVA dissolves to expose the underlying reactive core, thereby causing the core to react. Surface layers that activate under exposure to specific temperatures, pressures, fluids, electromagnetic waves and/or mechanical environments to delay the initiation of a dissolution reaction are envisioned by the present invention.

In accordance with the present invention, a metal, metal alloy, metal matrix composite, polymer, or polymer composite having a specified reactive function can form all or part of the core. One of the primary functions of the core is for the material of the core to partially or fully disintegrate in a controlled and uniform manner upon exposure an environmental condition (e.g., exposure to saltwater, etc.). On the surface of the core (which core can be a casting, forging, extrusion, pressed, molded, or machined part), a surface layer is included to modify the conditions to which the core will react. In one non-limiting configuration, the core has a strength above 25,000 psig, and is selected to respond to a set of environmental conditions to perform a function (e.g., react, dissolve, corrode, fracture, generate heat, etc.).

In one non-limiting formulation, the core can be or include magnesium or magnesium alloy that has a temperature-dependent dissolution or disintegration rate. This disintegration rate of the core can be designed such that the core dissolves, corrodes, reacts, and/or chemically reacts in a certain period of time at a given temperature. One non-limiting application that can use such a core is a frac ball. The composite system can be designed such that the core does not disintegration at a temperature of less than about 100° F. via protection from the surface layer. As can be appreciated, the temperature can be any temperature (e.g., below 10° F., below 50° F., below 100° F., below 150° F., below 200° F., etc.). In one embodiment, wherein the hierarchically-designed component or system is designed to inhibit or prevent reaction of the core at a temperature below 100° F., the core would have a near-infinite life at conditions below 100° F. To accomplish this non-limiting embodiment, the hierarchically-designed component or system has a surface layer that is applied to the surface of the core, wherein the surface layer is inert under conditions wherein the temperature is below 100° F., but dissolves, corrodes, or degrades once the temperature exceeds 100° F. (e.g., dissolves, corrodes, or degrades in the presence of water that exceeds 100° F., dissolves, corrode, or degrades in the present of air that exceeds 100° F., etc.) In this non-limiting embodiment, the kinetics of the reaction can be changed by inhibiting the initial reaction, and then accelerating the reaction once specific conditions are met. As can be appreciated, the surface layer can be caused to dissolve, corrode, or degrade upon exposure to other conditions (e.g., certain liquids, certain gasses, certain temperatures, certain electromagnetic waves, certain vibrations, and/or certain sound waves, certain pH, certain salt content, certain electrolyte content, certain magnetism, certain pressure, electricity, and/or certain temperature, etc.).

Because the surface layer may be exposed to high stress, surface layer can be thin (e.g., 0.01-50 mils, typically 0.01-10 mils, more typically 0.01-5 mils, etc.); however, this is not required. Alternatively, the surface layer can be designed to be strong and to contribute mechanically to the system, such as through the use of fiber, flakes, metals, metal alloys, and/or whisker reinforcement in the layer. The thickness of the surface layer about the core can be uniform or vary.

Example 1

A magnesium frac ball is produced having a disintegration rate of about 0.7-1.4 mm/hr at 200° F. and about 0.01-0.04 mm/hr at 100° F. The frac ball is designed to able to withstand at least a 24-hour exposure to 80° F. water in a ball drop system. The magnesium core can be magnesium, magnesium alloy or a magnesium composite. As can be appreciated, the core can be formed of other metals and/or non-metals that react, dissolve, corrode, or disintegrate at a rate of 0.1-100 mm hr at 100-300° F. in water or salt water. The magnesium frac ball can be undermachined by 0.001-0.2" (e.g., 0.005", etc.) from final dimensions, and a 0.001-0.2" coating (e.g., 0.005" coating, etc.) of PVA can be applied to the surface through a spray-coating process. FIG. 1 illustrates one non-limiting configuration of the frac ball. Although not illustrated in FIG. 1, the core can be formed of multiple layers of material wherein each layer has a different composition from the adjacently positioned layer. For example, the first or central layer of the core could include a magnesium composite material, and a second layer that is applied about the first layer could be magnesium or magnesium alloy. Likewise, the surface layer can include one or more different layers wherein each layer has a different composition from the adjacently positioned layer. The thickness of the two or more layers of the surface layer (when used) can be the same or different. Likewise, the thickness of the two or more layers of the core (when used) can be the same or different. The PVA is very insoluble in water up to about 130-150° F. At temperatures above 150° F., the PVA becomes dissolvable and ultimately exposes the magnesium core. The magnesium frac ball has excellent mechanical properties (e.g., generally above 30 ksi strength), and when the magnesium frac ball is exposed to slightly acidic or salt solutions, the magnesium frac ball corrodes at a rate of about 0.1-15 mm/day. However, when the magnesium frac ball is exposed to temperatures below about 130° F., the magnesium frac ball does not dissolve or corrode. As can be appreciated, the thickness of the coating of PVA can be selected to control the time needed for the PVA to dissolve and thereby expose the core to the surrounding environment.

Example 2

A high-strength frac ball is produced using a low-density core, which frac ball is selected for having good compressive strength and low density, and having a surface layer of a higher tensile strength and a denser material than the core. The core is selected from a magnesium composite that uses a high corrosion magnesium alloy matrix with carbon, glass, and/or ceramic microballoons or balls to reduce its density to below 1.7 g/cc (e.g., 0.5-1.66 g/cc and all values and ranges therebetween) and typically below about 1.3 g/cc. As can be appreciated, other densities of the core can be used. This composite core has very good compressive strengths, but tensile strengths may, in some applications, be inadequate for the intended application. For example, the tensile strength of the composite core may be less than 35 ksi, typically less than 32 ksi, and more typically less than 30 ksi. As such, the composite core can be surrounded by another layer having a greater tensile strength. This surrounding layer can have a thickness of about 0.035-0.75" (and all values and ranges therebetween) and typically about 0.1-

0.2". The surrounding layer can be formed of magnesium, magnesium alloy or a high-strength magnesium composite. The high strength outer layer is designed to have adequate tensile strength and toughness for the applications, and generally has a tensile strength that is greater than 33 ksi, typically greater than 35 ksi, and more typically greater than 45 ksi; however, the tensile strength can have other values. The resultant component can have an overall density of about 5-45% lower (and all values and ranges therebetween) than a pure magnesium alloy ball, and typically about 30% lower than a pure magnesium alloy ball, but also has the high tensile and shear strengths needed to perform the desired ball actuator application.

The core of the high-strength frac ball can be heat treated and machined after fabrication. A surface layer can optionally be applied to the core using thermal spray, co-extrusion, casting, or through power metallurgy techniques suitable for its fabrication as discussed in Example 1.

Example 3

A magnesium frac ball is produced having a disintegration rate of about 0.7-1.4 mm/hr at 200° F. and about 0.01-0.04 mm/hr at 100° F. The frac ball is designed to be able to withstand at least a 24-hour exposure to 80° F. water in a ball drop system. The magnesium frac ball can be undermachined by 0.001-0.2" (e.g., 0.005", etc.) from final dimensions, and a 0.001-0.2" coating (e.g., 0.005" coating, etc.) of zinc metal can be applied to the surface of the magnesium core. The magnesium core can be magnesium, magnesium alloy or a magnesium composite. As can be appreciated, the core can be formed of other metal and/or non-metals that react, corrode, dissolve or disintegrate at a rate of 0.1-100 mm/hr at 100-300° F. in water or salt water. The resultant compact has high mechanical properties, generally about 28 ksi and typically above 30 ksi strength (e.g., 30-45 ksi and all values and ranges therebetween). When the core of the magnesium frac ball is exposed to salt solutions, the magnesium frac ball corrodes at a rate of about 0.1-15 mm/day depending on the environment and temperature. The magnesium frac ball is designed to not react or corrode until activated with an acid exposure that removes the zinc surface layer and exposes the underlying magnesium core.

Example 4

A high-strength frac ball is produced using a low-density core, which frac ball is selected for having good compressive strength and low density, and having a surface layer of a higher tensile strength, and a denser material than the core. The core is selected from a magnesium composite that uses a high corrosion magnesium alloy matrix with carbon, glass, and/or ceramic microballoons or balls to reduce its density to below 1.7 g/cc (e.g., 0.5-1.66 g/cc and all values and ranges therebetween) and typically below about 1.3 g/cc. As can be appreciated, other densities of the core can be used. This composite core has very good compressive strengths, but tensile strengths may, in some applications, be inadequate for the intended application. For example, the tensile strength of the composite core may be less than 35 ksi, typically less than 32 ksi, and more typically less than 30 ksi. As such, the composite core can be surrounded by another layer having a greater tensile strength. Surrounding the composite core is high-strength metal or metal alloy (e.g., zinc, etc.) that has a layer thickness of about 0.035-0.75", and typically about 0.1-0.2". The high-strength metal or metal alloy outer layer is designed to have adequate tensile strength and toughness for certain the applications, and is generally greater than 33 ksi, typically greater than 35 ksi, and more typically greater than 45 ksi; however, the tensile strength can have other values. The resultant component can have an overall density of about 5-60% lower (and all values and ranges therebetween) than a pure zinc alloy ball, and typically about 50% lower than a pure zinc alloy ball, but also has the high tensile and shear strengths needed to perform the desired ball actuator application.

Example 5

A reactive material containing a water-reactive substance such as, but not limited to, lithium, is formed into a particle. The lithium is added to a propellant mixture. The propellant mixture can include polyvinylidene difluoride (PVDF), ammonium nitrate, and/or aluminum to form a gas-generating composition. The lithium particle can optionally include a polymer coating (e.g., PVA, etc.) that is applied to its surface to protect it from contact with water. The polymer coating is formulated to be insoluble at room temperature, but can dissolve in hot water (e.g., +140° F.). Once the coating is dissolved to expose the lithium, the lithium reacts with water and releases heat, thus igniting the propellant (e.g., aluminum-ammonium nitrate-PVDF propellant, etc.) to generate heat and gas pressure. As can be appreciated, other reactive particles can be used (e.g., lithium, sodium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, divalent cation alanates, and/or other water-reactive materials, etc.).

Example 6

A reactive material containing a water-reactive substance such as, but not limited to, sodium, is formed into a particle. The sodium is added to a propellant mixture. The propellant mixture can include PVDF, ammonium nitrate, and/or aluminum to form a gas-generating composition. The sodium particle can optionally include a polymer coating (e.g., PVAP, etc.) that is applied to its surface to protect it from contact with water. The polymer can optionally be a polymer that is insoluble in water-containing environments having an acidic pH, but is soluble in neutral or basic water containing environments; however, this is not required. One such polymer is polyvinyl acetate phthalate (PVAP). As can be appreciated, the polymer can optionally be selected to be insoluble in water-containing environments having a basic or neutral pH, but is soluble in an acidic water-containing environments; however, this is not required. The reactive material can be pumped into a formation using a solution having a pH wherein the polymer does not dissolve or degrade. Once the reactive material is in position, the pH solution can be changed to cause the polymer to dissolve or degrade, thereby exposing the sodium to the water and thus igniting the propellant by the heat generated by the sodium exposure to water to thereby generate localized heat and pressure. As can be appreciated, other reactive particles can be used (e.g., lithium, sodium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, divalent cation alanates, and/or other water-reactive materials, etc.).

Example 7

A magnesium frac ball is produced having a disintegration rate of about 0.7-1.4 mm/hr at 200° F. and about 0.01-0.04 mm/hr at 100° F. The frac ball is designed to able to withstand at least one day, typically at least seven days, and more typically at least 14 days exposure to 80° F.+ water or a water system having an acidic pH in a ball drop system or a down hole application (e.g., ball/ball seat assemblies, fracture plugs, valves, sealing elements, well drilling tools, etc.). The magnesium core can be magnesium, magnesium alloy or a magnesium composite. As can be appreciated, the core can be formed of other metal and/or non-metals that react, corrode, dissolve or disintegrate at a rate of 0.1-100 mm/hr at 100-300° F. in water or salt water. The magnesium frac ball can be undermachined by 0.001-0.2" (e.g., 0.005", etc.) from final dimensions, and a 0.001-0.2" coating (e.g., 0.005" coating, etc.) of PVA can be applied to the surface through a spray-coating process. The PVA is very insoluble in water up to about 130-150° F. At temperatures above 150° F., the PVA becomes dissolvable. To prevent dissolution of the PVA above 150° F., the PVA coating is modified with a silicone component such as, but not limited to, trimethylsilyl group to convert the PVA to a protected ether silyl layer that is insoluble in water, salt water, and acidic water solutions, even when such solutions exceed 150° F. Non-limiting examples of compounds that include the trimethylsilyl group include trimethylsilyl chloride, bis(trimethylsilyl)acetamide, trimethylsilanol, and tetramethylsilane. FIG. 2 illustrates an example of a surface treatment layer such as compound having a trimethylsilyl group that is applied to the outer surface of a surface layer of PVA, and wherein the PVA surrounds a core. The converted PVA can be converted back to PVA (e.g., the protected ether silyl is removed from the PVA) by exposing the converted PVA to an ammonium fluoride solution or similar solution which thereby converts the surface back to PVA. At temperatures above 150° F., the PVA becomes dissolvable and ultimately exposes the magnesium core. The magnesium frac ball has excellent mechanical properties (e.g., generally above 30 ksi strength), and when the magnesium frac ball is exposed to slightly acidic or salt solutions, the magnesium frac ball corrodes at a rate of about 0.1-15 mm/day. However, when the magnesium frac ball is exposed to temperatures below about 130° F., the magnesium frac ball does not dissolve or corrode. As can be appreciated, the thickness of the coating of PVA can be selected to control the time needed for the PVA to dissolve and thereby expose the core to the surrounding environment. Also as can be appreciated, the modification of the coating of PVA can be selected to achieve control of exposure of the core to the surrounding environment.

Example 8

A silicone coating (e.g., polymer-based siloxane two-part coating) was sprayed onto a dissolvable metal sphere and cured for seven days. The dissolvable metal sphere can be formed of magnesium, magnesium alloy, a magnesium composite or metal and/or non-metals that react, corrode, dissolve or disintegrate at a rate of 0.1-100 mm/hr at 100-300° F. in water or salt water. The coating thickness was about 0.003"; however, the coating thickness can be other thicknesses (e.g., 0.001-0.1" and any value or range therebetween, etc.). The coated ball was then submersed in 200° F. of HCl (e.g., 0.1-3M HCl) for 65 min with no evidence of reaction of the metal sphere. 0.1 M HF was thereafter added to the 200° F. HCl solution (e.g., 0.1-3M HCl) and the silicone coating separated from the metal sphere in less than 30 minutes (e.g., 0.1-30 minutes and all values and ranges therebetween), The silicone coating is generally formulated to separate from the metal sphere when exposed to certain solutions in about 0.1-180 minutes (and all values and ranges therebetween), depending on the type, concentration and temperature of the solution. The metal that was dissolvable then started dissolving in the HCl solution. In another example, the same silicone polymer was sprayed onto a dissolvable metal plate and cured for seven days. The dissolvable metal plate can be formed of magnesium, magnesium alloy, a magnesium composite or metal and/or non-metals that react, corrodes, dissolves or disintegrate at a rate of 0.1-100 mm/hr at 100-300° F. in water or salt water. The coating thickness was about 0.006". The coated plate was then subjected to a simulated pipe line sliding wear equivalent to 5000 feet of sliding wear. The silicone coating exhibited little or no removal of material and the dissolvable metal plate was not exposed to any sliding wear.

Example 9

A polymer-based polyurethane coating (e.g., one-or two-part coating) was applied (e.g., electrostatically, etc.) to the surface of a dissolvable metal sphere and cured above 300° F. for about 15 min. The dissolvable metal sphere can be formed of magnesium, magnesium alloy, a magnesium composite or metal and/or non-metals that react, corrode, dissolve or disintegrate at a rate of 0.1-100 mm/hr at 100-300° F. in water or salt water. The coated sphere was cooled to room temperature and submerged in 80° F. 15% HCl solution (i.e., 2.75M HCl) for 60 min. No degradation of the coating or ball was observed and no dimensions changed. The coated sphere was then moved to a 200° F. 3% KCl solution (i.e., 0.4M KCl). The coating started to degrade after about 30 minutes at the elevated temperature and the dissolvable metal sphere thereafter degraded with the removal of the silicone coating. The silicone coating is generally formulated to separate from the metal sphere when exposed to certain solutions in about 0.1-180 minutes (and all values and ranges therebetween), depending on the type, concentration and temperature of the solution.

Example 10

A polymer-based PVB coating was coated (e.g., electrostatically applied, etc.) to the surface of a dissolvable metal sphere and cured above 300° F. for about 30 minutes. The dissolvable metal sphere can be formed of magnesium, magnesium alloy, a magnesium composite or metal and/or non-metals that reacts, corrode, dissolves or disintegrates at a rate of 0.1-100 mm/hr at 100-300° F. in water or salt water. The coating was abrasion resistant and had excellent adhesion to the sphere. The coated sphere was cooled to room temperature and submerged in 80° F. 15% HCl solution for about 60 minutes. No degradation of the coating or metal sphere was observed and the coated sphere did not exhibit any dimensional changes. The coated sphere was then moved to a 200° F. 3% KCl solution. The coating on the metal sphere started to degrade after about 30 min at the elevated temperature and the dissolvable metal sphere degraded with the removal of the PVB. The PVB coating is generally formulated to separate from the metal sphere when exposed to certain solutions in about 0.1-180 minutes (and all values and ranges therebetween), depending on the type, concentration and temperature of the solution.

Example 11

A polymer-based. PVB coating was coated (e.g., coated using a solvent, etc.) to the surface of a dissolvable metal sphere and cured above 300° F. for about 30 minutes. The dissolvable metal sphere can be formed of magnesium, magnesium alloy, a magnesium composite or metal and/or non-metals that react, corrode, dissolve or disintegrate at a rate of 0.1-100 mm/hr at 100-300° F. in water or salt water. The coating was abrasion resistant and had excellent adhesion to the sphere. The coated sphere was cooled to room temperature and submerged in 80° F. 15% HCl solution for about 60 minutes. No degradation of the coating or metal sphere was observed and the coated sphere did not exhibit any dimensional changes. The coated sphere was then moved to a 200° F. 3% KCl solution. The coating on the metal sphere started to degrade after about 30 minutes at the elevated temperature and the dissolvable metal sphere degraded with the removal of the PVB. The PVB coating is generally formulated to separate from the metal sphere when exposed to certain solutions in about 0.1-180 minutes (and all values and ranges therebetween), depending on the type, concentration and temperature of the solution.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A method for controlling the dissolving, degrading, reacting, and/or fracturing of a component for use in down-hole applications comprising:

a. providing a down-hole component for use in down-hole applications, said down-hole component at least partially formed of a hierarchically-designed reactive component, said hierarchically-designed reactive component includes:

i. a core, said core dissolvable and/or reactive in the presence of a down-hole fluid environment, at least 70 wt. % of said core including a core material that includes one or more water-reactive materials selected from the group consisting of lithium, sodium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, and divalent cation alanates; and, ii. a surface layer partially or fully encapsulatings said core, said surface layer having a different composition from said core, said surface layer includes polymer, said polymer formulated to have a chemical reaction when exposed to a chemical trigger, said surface layer formulated to be insoluble in said down-hole fluid environment and soluble in said down-hole fluid environment when chemically modified by said chemical trigger; said surface layer forming a protective layer about said core to inhibit or prevent said core from degrading, dissolving, and/or reacting when said component is exposed to said down-hole fluid environment in said down-hole applications, said surface layer is not degradable, dissolvable, and/or reactable in said down-hole fluid environment until said surface layer is exposed to an activation event which thereafter causes said surface layer to controllably dissolve in said down-hole fluid environment;

b. inserting said down-hole component into a well, said surface layer of said hierarchically-designed reactive component does not or substantially does not dissolve, degrade, and/or react when exposed to said down-hole fluid environment in said well;

c. exposing said surface layer of said hierarchically-designed reactive component to said activation event in the form of said chemical trigger to cause said surface layer to degrade, dissolve, and/or react to thereby expose said core to said down-hole fluid environment; and, d. causing said exposed core to degrade, dissolve, react, and/or fracture when exposed to said down-hole fluid environment, said degradation, dissolving, reacting, and/or fracturing of said core thereby causing said down-hole component to at least partially degrade, dissolve, react, and/or fracture.

2. The method as defined in claim 1, wherein said down-hole component is selected from the group consisting of a frac ball, a valve, a plug, a ball, a sleeve, a casing, a hydraulic actuating tool, a ball/ball seat assembly, a fracture plug, sealing elements, and a well drilling tool.

3. The method as defined in claim 1, wherein said down-hole fluid environment is a water-containing environment, said core having a dissolution rate in said down-hole fluid environment of 0.1-100 mm/hr at 100-300° F.

4. The method as defined in claim 1, wherein said activation event further includes a temperature increase of said down-hole fluid environment to facilitate in causing said surface layer to degrade, dissolve, or combinations thereof.

5. The method as defined in claim 1, wherein said activation event further includes a change in pH of said down-hole fluid environment to facilitate in causing said surface layer to degrade, dissolve, or combinations thereof.

6. The method as defined in claim 1, wherein said surface layer includes a silicon-containing compound.

7. The method as defined in claim 6, wherein said chemical trigger is a fluorine ion source.

8. The method as defined in claim 1, wherein said core has a compression strength above 5000 psig, a density of no more than 1.7 g/cc, and a tensile strength of less than 30,000 psig.

9. The method as defined in claim 1, wherein said surface layer includes a fiber-reinforced metal.

10. The method as defined in claim 1, wherein said core is formulated to react with said down-hole fluid environment to cause rapid heat generation which in turn causes said core to ignite.

11. The method as defined in claim 1, wherein said core includes a metal fuel and oxidizer composite which includes one or more mixtures of a reactive metal, an oxidizer, or thermite pair, said reactive metal including one or more metals selected from the group consisting of magnesium, zirconium, tantalum, titanium, hafnium, calcium, tungsten, molybdenum, chrome, manganese, silicon, germanium, and aluminum, said oxidizer or thermite pair including one or more compounds selected from the group consisting of fluorinated or chlorinated polymer, oxidizer, and intermetallic thermite.

12. The method as defined in claim 11, wherein said surface layer includes polyvinyl alcohol, polyvinyl alcohol modified with a silicone component, polyvinyl acetate phthalate, silicone, polymer-based polyurethane, and polymer-based polyvinyl butyral.

13. The method as defined in claim 1, wherein said core includes a reactive polymeric material including one or more materials selected from the group consisting of aluminum-potassium perchlorate-polyvinylidene difluoride and tetrafluoroethylene (THV) polymer.

14. The method as defined in claim 1, wherein said surface layer includes one or more materials selected from the group consisting of zinc, zinc alloy, ethylene-α-olefin copolymer, linear styrene-isoprene-styrene copolymer, ethylene-butadiene copolymer, styrene-butadiene-styrene copolymer, copolymer having styrene endblocks and ethylene-butadiene or ethylene-butene midblocks, copolymer of ethylene and alpha olefin, ethylene-octene copolymer, ethylene-hexene copolymer, ethylene-butene copolymer, ethylene-pentene copolymer, ethylene-butene copolymer, polyvinyl alcohol, polyvinyl butyral, silicone-based coating, and polyurethane-based coating.

15. A method for controlling the dissolving, degrading, reacting, and/or fracturing of a component for use in down-hole applications comprising:

a. providing a down-hole component for use in down-hole applications, said down-hole component selected from the group consisting of a frac ball, a valve, a plug, a ball, a sleeve, a casing, a hydraulic actuating tool, a ball/ball seat assembly, a fracture plug, sealing elements, and a well drilling tool, said down-hole component at least partially formed of a hierarchically-designed reactive component, said hierarchically-designed reactive component includes:

i. a core, said core dissolvable and/or reactive in the presence of a down-hole fluid environment, at least 70 wt. % of said core including a core material selected from the group consisting of lithium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, and divalent cation alanates; and, ii. a surface layer partially or fully encapsulating said core, said surface layer having a different composition from said core, said surface layer formulated to have a chemical reaction when exposed to said chemical trigger, said surface layer formulated to be insoluble in said down-hole fluid environment and soluble in said down-hole fluid environment when chemically modified by said chemical trigger; said surface layer forming a protective layer about said core to inhibit or prevent said core from degrading, dissolving, and/or reacting when said component is exposed to a down-hole fluid environment in said down-hole applications, said surface layer is not degradable, dissolvable, and/or reactable in said down-hole fluid environment until said surface layer is exposed to said chemical trigger which thereafter causes said surface layer to controllably dissolve in said down-hole fluid environment;

b. inserting said down-hole component into a well, said surface layer of said hierarchically-designed reactive component does not or substantially does not dissolve, degrade, and/or react when exposed to said down-hole fluid environment in said well;

c. exposing said surface layer of said hierarchically-designed reactive component to said chemical trigger to cause said surface layer to degrade, dissolve, and/or react to thereby expose said core to said down-hole fluid environment; and, d. causing said exposed core to degrade, dissolve, react, and/or fracture when exposed to said down-hole fluid environment, said degradation, dissolving, reacting, and/or fracturing of said core thereby causing said down-hole component to at least partially degrade, dissolve, react, and/or fracture.

16. The method as defined in claim 15, wherein said surface layer includes one or more materials selected from the group consisting of ethylene-α-olefin copolymer, linear styrene-isoprene-styrene copolymer, ethylene-butadiene copolymer, styrene-butadiene-styrene copolymer, copolymer having styrene endblocks and ethylene-butadiene or ethylene-butene midblocks, copolymer of ethylene and alpha olefin, ethylene-octene copolymer, ethylene-hexene copolymer, ethylene-butene copolymer, ethylene-pentene copolymer, ethylene-butene copolymer, polyvinyl alcohol, polyvinyl butyral, silicone-based coating, and polyurethane-based coating.

17. The method as defined in claim 15, wherein said surface layer includes polyvinyl alcohol, polyvinyl alcohol modified with a silicone component, polyvinyl acetate phthalate, silicone, polymer-based polyurethane, and polymer-based polyvinyl butyral.

18. The method as defined in claim 15, wherein said down-hole fluid environment is a water-containing environment, said core having a dissolution rate in said down-hole fluid environment of 0.1-100 mm/hr at 100-300° F.

19. The method as defined in claim 15, wherein said surface layer includes a silicon-containing compound.

20. The method as defined in claim 19, wherein said chemical trigger is a fluorine ion source.

21. The method as defined in claim 15, wherein said core has a compression strength above 5000 psig, a density of no more than 1.7 g/cc, and a tensile strength of less than 30,000 psig.

22. A method for controlling the dissolving, degrading, reacting, and/or fracturing of a component for use in down-hole applications, said method comprises:

a. providing a down-hole component for use in down-hole applications, said down-hole component selected from the group consisting of a frac ball, a valve, a plug, a ball, a sleeve, a casing, a hydraulic actuating tool, a ball/ball seat assembly, a fracture plug, sealing elements, and a well drilling tool, said down-hole component at least partially formed of a hierarchically-designed reactive component, said hierarchically-designed reactive component includes:

i. a core, said core dissolvable and/or reactive in the presence of a down-hole fluid environment, at least 70 wt. % of said core including a core material selected from the group consisting of lithium, potassium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, and divalent cation alanates; and, ii. a surface layer partially or fully encapsulating said core, said surface layer having a different composition from said core, said surface layer including one or more materials selected from the group consisting of ethylene-α-olefin copolymer, linear styrene-isoprene-styrene copolymer, ethylene-butadiene copolymer, styrene-butadiene-styrene copolymer, copolymer having styrene endblocks and ethylene-butadiene or ethylene-butene midblocks, copolymer of ethylene and alpha olefin, ethylene-octene copolymer, ethylene-hexene copolymer, ethylene-butene copolymer, ethylene-pentene copolymer, ethylene-butene copolymer, polyvinyl alcohol, polyvinyl butyral, silicone-based coating, and polyurethane-based coating, said surface layer formulated to have a chemical reaction when exposed to a chemical trigger, said surface layer formulated to be insoluble in said down-hole fluid environment and soluble in said down-hole fluid environment when chemically modified by said chemical trigger; said surface layer forming a protective layer about said core to inhibit or prevent said core from degrading, dissolving, and/or reacting when said component is exposed to said down-hole fluid environment in said down-hole applications, said surface layer is not degradable, dissolvable, and/or reactable in said down-hole fluid environment until said surface layer is exposed to said chemical trigger which thereafter causes said surface layer to controllably dissolve in said down-hole fluid environment;

b. inserting said down-hole component into a well, said surface layer of said hierarchically-designed reactive component does not or substantially does not dissolve, degrade, and/or react when exposed to said down-hole fluid environment in said well;

c. exposing said surface layer of said hierarchically-designed reactive component to said chemical trigger to cause said surface layer to degrade, dissolve, and/or react to thereby expose said core to said down-hole fluid environment; and, d. causing said exposed core to degrade, dissolve, react, and/or fracture when exposed to said down-hole fluid environment, said degradation, dissolving, reacting, and/or fracturing of said core thereby causing said down-hole component to at least partially degrade, dissolve, react, and/or fracture.

23. The method as defined in claim 22, wherein said surface layer includes one or more materials selected from the group consisting of polyvinyl alcohol and polyvinyl butyral.

24. The method as defined in claim 22, wherein said down-hole fluid environment is a water-containing environment in a down hole, said core having a dissolution rate in said down-hole fluid environment of 0.1-100 mm/hr at 100-300° F.

25. The method as defined in claim 22, wherein said chemical trigger is a fluorine ion source.

26. The method as defined in claim 22, wherein said core has a compression strength above 5000 psig, a density of no more than 1.7 g/cc, and a tensile strength of less than 30,000 psig.

27. A method for controlling the dissolving, degrading, reacting, and/or fracturing of a component for use in down-hole applications, said method comprises:

a. providing a down-hole component for use in down-hole applications; said down-hole component selected from the group consisting of a frac ball, a valve, a plug, a ball, a sleeve, a casing, a hydraulic actuating tool, a ball/ball seat assembly, a fracture plug, sealing elements, and a well drilling tool; said down-hole component at least partially formed of a hierarchically-designed reactive component said hierarchically-designed reactive component includes:

i. a core, said core dissolvable and/or reactive in the presence of a down-hole fluid environment at least 70 wt. % of said core including a core material selected from the group consisting of aluminum, calcium, lithium, magnesium, potassium, sodium, lithium aluminum hydride, sodium aluminum hydride, potassium aluminum hydride, magnesium aluminum hydride, lithium borohydride, sodium borohydride, calcium borohydride, magnesium hydride, n-Al, borohydride mixed with alanates, metal hydrides, borohydrides, and divalent cation alanates; and, ii. a surface layer partially or fully encapsulating said core; said surface layer having a different composition from said core; said surface layer including one or more materials selected from the group consisting of ethylene-α-olefin copolymer, linear styrene-isoprene-styrene copolymer, ethylene-butadiene copolymer, styrene-butadiene-styrene copolymer, copolymer having styrene endblocks and ethylene-butadiene or ethylene-butene midblocks, copolymer of ethylene and alpha olefin, ethylene-octene copolymer, ethylene-hexene copolymer, ethylene-butene copolymer, ethylene-pentene copolymer, ethylene-butene copolymer, polyvinyl alcohol, polyvinyl butyral, silicone-based coating, and polyurethane-based coating; said surface layer includes polyvinyl alcohol modified with a silicone component said surface layer formulated to have a chemical reaction when exposed to a chemical trigger; said surface layer formulated to be insoluble in said down-hole fluid environment and soluble in said down-hole fluid environment when chemically modified by said chemical trigger; said surface layer forming a protective layer about said core to inhibit or prevent said core from degrading, dissolving, and/or reacting when said component is exposed to said down-hole fluid environment in said down-hole applications;

said surface layer is not degradable, dissolvable, and/or reactable in said down-hole fluid environment until said surface layer is exposed to said chemical trigger which thereafter causes said surface layer to controllably dissolve in said down-hole fluid environment;

b. inserting said down-hole component into a well, said surface layer of said hierarchically-designed reactive component does not or substantially does not dissolve, degrade, and/or react when exposed to said down-hole fluid environment in said well;

c. exposing said surface layer of said hierarchically-designed reactive component to said chemical trigger to cause said surface layer to degrade, dissolve, and/or react to thereby expose said core to said down-hole fluid environment and, d. causing said exposed core to degrade, dissolve, react, and/or fracture when exposed to said down-hole fluid environment, said degradation, dissolving, reacting, and/or fracturing of said core thereby causing said down-hole component to at least partially degrade, dissolve, react, and/or fracture.

* * * * *